US007588241B2

(12) United States Patent
Murata et al.

(10) Patent No.: US 7,588,241 B2
(45) Date of Patent: Sep. 15, 2009

(54) SHEET PROCESSING APPARATUS, SHEET PROCESSING METHOD, IMAGE FORMING APPARATUS, PROGRAM FOR IMPLEMENTING THE METHOD, AND STORAGE MEDIUM STORING THE PROGRAM

(75) Inventors: Mitsushige Murata, Yokohama (JP); Takayuki Fujii, Tokyo (JP); Toshiyuki Miyake, Toride (JP)

(73) Assignee: Canon Kabushiki Kaisha (JP)

( * ) Notice: Subject to any disclaimer, the term of this patent is extended or adjusted under 35 U.S.C. 154(b) by 431 days.

(21) Appl. No.: 11/537,067

(22) Filed: Sep. 29, 2006

(65) Prior Publication Data

US 2007/0069452 A1 Mar. 29, 2007

(30) Foreign Application Priority Data

Sep. 29, 2005 (JP) ..... 2005-285059

(51) Int. Cl.
*B65H 37/04* (2006.01)

(52) U.S. Cl. ..... 270/58.11; 270/58.01; 270/58.07; 270/58.09

(58) Field of Classification Search ..... 270/58.01, 270/58.04, 58.07, 58.09, 58.11; 271/184, 271/185, 186

See application file for complete search history.

(56) References Cited

U.S. PATENT DOCUMENTS 6,353,726 B1 3/2002 Murata et al.
2003/0219295 A1* 11/2003 Saitoh et al. ..... 399/410
2006/0119879 A1* 6/2006 Nakai et al. ..... 358/1.14

FOREIGN PATENT DOCUMENTS

JP 11-258882 A 9/1999

* cited by examiner

*Primary Examiner*—Gene Crawford
*Assistant Examiner*—Leslie A Nicholson, III
(74) *Attorney, Agent, or Firm*—Rossi, Kimms & McDowell, LLP

(57) ABSTRACT

A sheet processing apparatus which can be reduced in size and suppress cost increase by preventing sheet buckling and jamming. Sheets stacked on an insert tray of a sheet processing apparatus are fed on a conveying path in a first sheet feed mode in which sheets are fed after being inverted by an inversion path or a second sheet feed mode in which sheets are fed without passing through the inversion path. A pair of conveying rollers conveys the fed sheets and the sheets with images formed thereon. The conveyed sheets are stacked on a processing tray, and a stapler performs predetermined processing on the stacked sheets. It is determined whether predetermined information is included in sheet information about the sheets stacked on the insert tray, and if the predetermined information is included in the set sheet information, a predetermined message is displayed on a display panel.

20 Claims, 31 Drawing Sheets

POSTPROCESSING SELECTION MENU

COVER DESIGNATION MENU (ERECT POSITION, FACE-UP)

FIG. 28

DESIGNATE INSERTER SHEET: SELECT SHEET ORIENTATION

FRONT COVER | BACK COVER

! SHEET OF DESIGNATED SHEET TYPE MAY NOT BE PROPERLY INSERTED AS BACK COVER.
MAKE SURE SHEET IS PLACED WITH BACK SIDE FACING UPWARD (FRONT SIDE FACING DOWNWARD) AND PRESS OK BUTTON

RETURN | OK

FIG. 29

DESIGNATE INSERTER SHEET: SELECT SHEET ORIENTATION

FRONT COVER | BACK COVER

RETURN | OK

SHEET PROCESSING APPARATUS, SHEET PROCESSING METHOD, IMAGE FORMING APPARATUS, PROGRAM FOR IMPLEMENTING THE METHOD, AND STORAGE MEDIUM STORING THE PROGRAM

BACKGROUND OF THE INVENTION

1. Field of the Invention

The present invention relates to controlling the insertion of sheets into a bundle of stacked sheets with images formed thereon.

2. Description of the Related Art

Some conventional copying apparatuses which are image forming apparatuses have a function of inserting a sheet (hereinafter referred to as "special sheet") different from a plain sheet to the first page, last page, or middle page of sheets. This function is referred to as a cover mode, an interleaving sheet mode, and so forth according to the page to which the special sheet is inserted. The user sets any of these modes through an operating section provided in such copying apparatuses. For example, a special sheet such as a sheet different in color from a plain sheet, a color copy sheet, or the like can be inserted as a cover sheet, and special sheets can be inserted as dividers between plain sheets every predetermined number of sheets (see U.S. Pat. No. 6,353,726).

Examples of methods to supply special sheets include a method in which special sheets are supplied from a cassette for use in supplying special sheets. Also, there has been proposed a method in which special sheets are supplied from a sheet feeder provided in a sheet processing apparatus such as a finisher which carries out postprocessing on sheets with images formed thereon output from a copying apparatus.

Also, there has been proposed a postprocessing method in which postprocessing such as stapling and punching is carried out on special sheets supplied from the above-mentioned sheet feeder.

In the case where the finisher carries out the above-mentioned postprocessing, a special sheet supplied from the sheet feeder or the cassette is inverted in a predetermined direction and laid over a sheet output from the copying apparatus.

The copying apparatus and the finisher are constructed in consideration of cases where various special sheets (such as a 300 g/m$^2$ sheet which is very thick) are conveyed.

The conventional copying apparatus and finisher, however, have to be large-sized because the curve of an inversion path which inverts special sheets needs to be gentle so as to prevent buckling and jamming of special sheets.

When jamming of a special sheet occurs, the user has to prepare the same special sheet again, which is troublesome for the user and causes cost increase.

SUMMARY OF THE INVENTION

It is an object of the present invention to provide a sheet processing apparatus and a sheet processing method which can reduce the size of the apparatus and suppress cost increase by preventing sheet buckling and jamming, an image forming apparatus, a program for implementing the method, and a storage medium storing the program.

To attain the above object, in a first aspect of the present invention, there is provided a sheet processing apparatus connected to an image forming apparatus that forms images corresponding to a set operation mode on sheets, comprising a first stacking section that stacks sheets, a curved inversion path that inverts the sheets, a sheet feed section that feeds the sheets stacked in the first stacking section in one of a first sheet feed mode in which sheets are fed after being inverted by the inversion path and a second sheet feed mode in which sheets are fed without passing through the inversion path, a conveying section that conveys the sheets fed by the sheet feed section and the sheets with the images formed thereon, a second stacking section that stacks the conveyed sheets, a sheet processing section that performs predetermined processing on the sheets stacked in the second stacking section, a setting section that sets sheet information about the sheets stacked in the first stacking section, a determining section that determines whether a predetermined information is included in the set sheet information, and a display section that displays a predetermined message when the predetermined information is included in the set sheet information.

Preferably, the sheet processing apparatus according comprises an inhibiting section that inhibits the inversion of the sheets by the inversion path when the predetermined information is included in the set sheet information.

Preferably, the predetermined information comprises information indicative of a special type sheet.

Preferably, the predetermined message comprises a message notifying a user that the inversion of the sheets by the inversion path has been inhibited.

Preferably, the predetermined message comprises a message prompting a user to confirm an orientation of the sheets stacked in the first stacking section Preferably, the predetermined message comprises a message prompting a user to change an orientation of the sheets stacked in the first stacking section.

To attain the above object, in a second aspect of the present invention, there is provided a sheet processing method for controlling a sheet processing apparatus connected to an image forming apparatus that forms images corresponding to a set operation mode on sheets, the sheet processing apparatus comprising a first stacking section that stacks sheets, a curved inversion path that inverts the sheets, a sheet feed section that feeds the sheets stacked in the first stacking section in one of a first sheet feed mode in which sheets are fed after being inverted by the inversion path and a second sheet feed mode in which sheets are fed without passing through the inversion path, a conveying section that conveys the sheets fed by the sheet feed section and the sheets with the images formed thereon, a second stacking section that stacks the conveyed sheets, and a sheet processing section that performs predetermined processing on the sheets stacked in the second stacking section, the method comprising a setting step of setting sheet information about the sheets stacked in the first stacking section, a determining step of determining whether a predetermined information is included in the set sheet information, and a display step of displaying a predetermined message when the predetermined information is included in the set sheet information.

Preferably, the sheet processing method comprises an inhibiting step of inhibiting the inversion of the sheets by the inversion path when the predetermined information is included in the set sheet information.

Preferably, the predetermined information comprises information indicative of a special type sheet.

Preferably, the predetermined message comprises a message notifying a user that the inversion of the sheets by the inversion path has been inhibited.

Preferably, the predetermined message comprises a message prompting a user to confirm an orientation of the sheets stacked in the first stacking section.

Preferably, the predetermined message comprises a message prompting a user to change an orientation of the sheets stacked in the first stacking section.

To attain the above object, in a third aspect of the present invention, there is provided an image forming apparatus comprising an image forming section that forms images on sheets, a first stacking section that stacks sheets, a curved inversion path that inverts the sheets, a sheet feed section that feeds the sheets stacked in the first stacking section in one of a first sheet feed mode in which sheets are fed after being inverted by the inversion path and a second sheet feed mode in which sheets are fed without passing through the inversion path, a conveying section that conveys the sheets fed by the sheet feed section and the sheets with the images formed thereon, a second stacking section that stacks the conveyed sheets, a sheet processing section that performs predetermined processing on the sheets stacked in the second stacking section, a setting section that sets sheet information about the sheets stacked in the first stacking section, a determining section that determines whether a predetermined information is included in the set sheet information, and a display section that displays a predetermined message when the predetermined information is included in the set sheet information.

To attain the above object, in a fourth aspect of the present invention, there is provided a program for causing a computer to execute a sheet processing method for controlling a sheet processing apparatus connected to an image forming apparatus that forms images corresponding to a set operation mode on sheets, the sheet processing apparatus comprising a first stacking section that stacks sheets, a curved inversion path that inverts the sheets, a sheet feed section that feeds the sheets stacked in the first stacking section in one of a first sheet feed mode in which sheets are fed after being inverted by the inversion path and a second sheet feed mode in which sheets are fed without passing through the inversion path, a conveying section that conveys the sheets fed by the sheet feed section and the sheets with the images formed thereon, a second stacking section that stacks the conveyed sheets, and a sheet processing section that performs predetermined processing on the sheets stacked in the second stacking section, the program comprising a setting module for setting sheet information about the sheets stacked in the first stacking section, a determining module for determining whether a predetermined information is included in the set sheet information, and a display module for displaying a predetermined message when the predetermined information is included in the set sheet information.

To attain the above object, in a fifth aspect of the present invention, there is provided a computer-readable storage medium storing a program according to the fourth aspect of the invention.

According to the present invention, sheet information about sheets stacked on the first stacking section is set, and if predetermined information is included in the set sheet information, a predetermined message is displayed. Thus, it is possible to make the apparatus compact and suppress cost increase by preventing sheet buckling and jamming.

The above and other objects, features, and advantages of the invention will become more apparent from the following detailed description taken in conjunction with the accompanying drawings.

BRIEF DESCRIPTION OF THE DRAWINGS

FIG. 5B is a view showing a state in which sheets are stacked on the insert tray of the inserter.

FIG. 28 is a view useful in explaining a screen displayed on the display panel in a step S2423 in FIG. 25.

FIG. 29 is a view useful in explaining a screen displayed on the display panel in a step S2422 in FIG. 25.

DETAILED DESCRIPTION OF THE PREFERRED EMBODIMENTS

The present invention will now be described in detail with reference to the drawings showing a preferred embodiment thereof.

Figure 1:
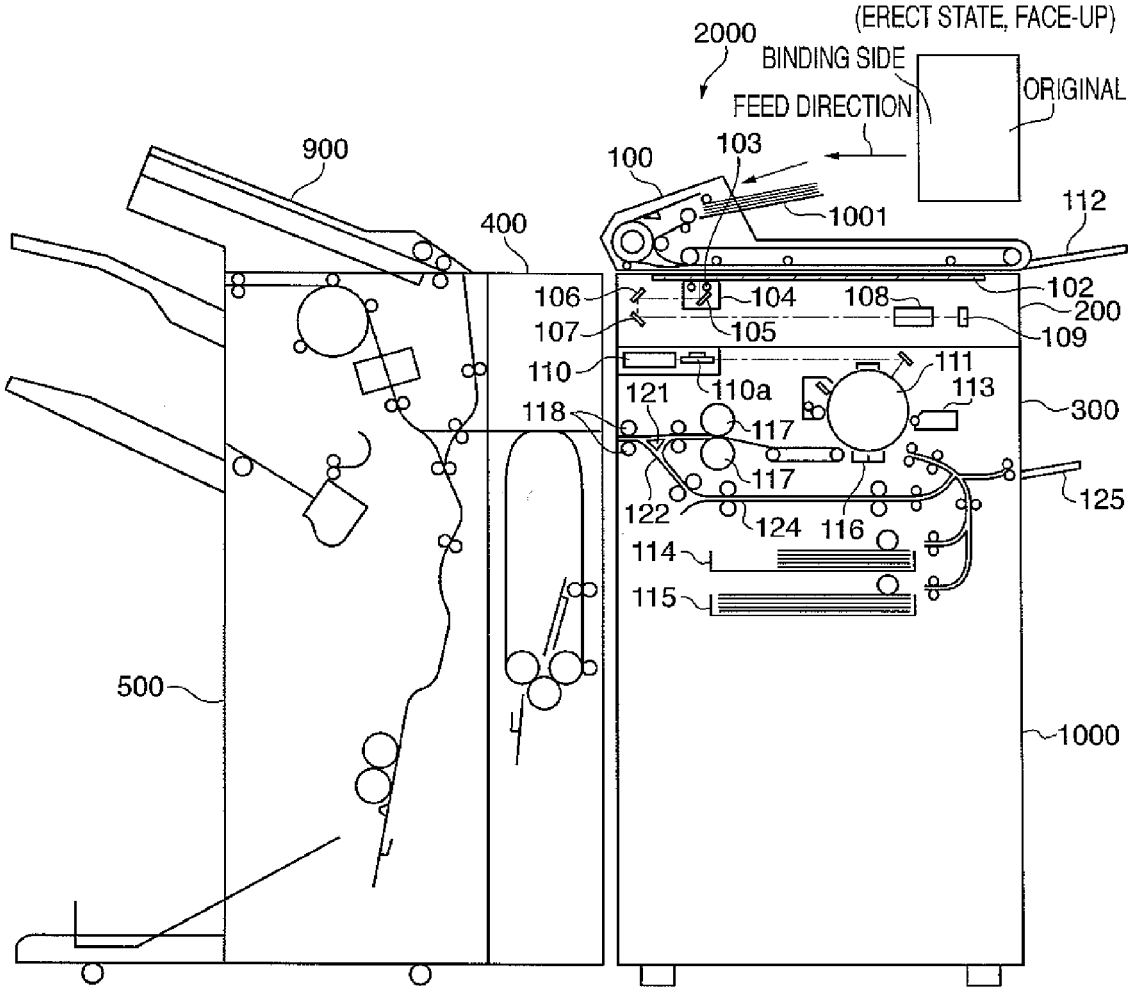
FIG. 1 is a sectional view schematically showing the internal construction of a copying system according to an embodiment of the present invention.

FIG. 1 is a sectional view schematically showing the internal construction of a copying system according to an embodiment of the present invention.

As shown in FIG. 1, the copying system 2000 is comprised of a copying apparatus 1000, a folding processing section 400, a finisher 500, and an inserter 900. The copying apparatus 1000 is comprised of an image reader section 200 and a printer section 300.

An image feeding section 100 is comprised of a tray 1001 on which originals are stacked. Originals stacked on the tray 1001 are sequentially conveyed one by one from the first page toward the left as viewed in FIG. 1. It should be noted that originals are placed on the tray 1001 in an erected image as viewed from the user and with surfaces thereof on which images are formed facing upward (hereinafter referred to as "the face-up state").

The original feeder 100 is provided with a discharged sheet tray 112 onto which the originals conveyed as mentioned above are discharged after being conveyed from left to right as viewed in FIG. 1 on a platen glass 102, described later, via a curved path.

The image reader section 200 is comprised of the platen glass 102 on which an original is placed, and a scanner unit 104 provided on a bottom of the platen glass 102.

The scanner unit 104 is comprised of a lamp 103, mirrors 105, 106, and 107, a lens 108, and an image sensor 109. The lamp 103 illuminates an original being conveyed. The mirrors 105, 106, and 107 guide reflected light from the illuminated original. The lens 108 guides the reflected light guided by the mirrors 105 to 107 to the image sensor 109. The image sensor 109 carries out photoelectric conversion of the incident reflected light through the lens 108 and outputs image data of the original.

Methods to read image data of an original using the scanner unit 104 include a moving original reading method and a fixed original reading method. In the moving original reading method, an image on an original is read while the original is conveyed from left to right as viewed in FIG. 1 on the platen glass 102 with the scanner unit 104 being held at a predetermined position. In the fixed original reading method, an image on an original is read while the scanner unit 104 is moved from left to right as viewed in FIG. 1 with the original being held on the platen glass 102.

In the fixed original reading method, the original feeder 100 may convey an original onto the platen glass 102, or alternatively, the user may lift the original feeder 100 and place an original on the platen glass 102 without using the original feeder 100.

The printer section 300 is provided with an exposure controller 110, a polygon mirror 110*a*, a photosensitive drum 111, and a developing unit 113. The exposure controller 110 receives image data output by the image sensor 109, carries out predetermined image processing on the received image data, and outputs the resulting image data as a laser beam. The polygon mirror 110*a* reflects the output laser beam while rotating and scans the photosensitive drum 111. The developing unit 113 develops and visualizes an electrostatic latent image formed on the photosensitive drum 111 by scanning as a toner image.

The printer section 300 is provided with cassettes 114 and 115 on which sheets are stacked, a manual sheet feed section 125, a double-sided conveying path 124, a transfer section 116, and a fixing section 117. The transfer section 116 transfers a toner image visualized as mentioned above onto conveyed sheets. The fixing section 117 fixes transferred toner images onto sheets.

The printer section 300 is further provided with a flapper 121, a pair of discharge rollers 118, and a conveying path 122. The flapper 121 switches the destination of a sheet to one of the folding processing section 400 and the double-sided conveying path 124. The discharge rollers 118 convey a sheet toward the folding processing section 400.

The conveying direction of a sheet conveyed to the path 122 by a switching action of the flapper 121 is reversed (switched back) after the trailing end of the sheet leaves the flapper 121, and the sheet is then conveyed to the discharge rollers 118 by a switching action of the flapper 121. The sheet is discharged from the printer section 300 by the discharge rollers 118 and conveyed to the folding processing section 400. In this way, the printer section 300 can discharge a sheet with a toner image formed thereon to the folding processing section 400 with a surface thereof on which the toner image has been formed facing downward (hereinafter referred to as "the face-down state"). This will hereafter be referred to as "inverted discharge (face-down discharge)."

By discharging sheets in the face-down state from the printer section 300 as described above, sheets with images formed thereon can be collated in the case where image formation is sequentially carried out on the first to last pages in this order. The cases where image formation is sequentially carried out on the first to last pages in this order include, for example, the case where image formation is carried out on image data of originals read by the original feeder 100 and the case where image formation is carried out on image data input from a computer.

In carrying out image formation on a hard sheet such as an OHP sheet fed from the manual sheet feed section 125, the printer section 300 discharges the OHP sheet in the face-up state to the folding processing section 400 without passing it through the path 122.

On the other hand, in carrying out image formation on both sides of a sheet, the sheet is conveyed directly from the fixing section 117 toward the discharging rollers 118. The sheet is switched back after the trailing end of the sheet leaves the flapper 121, and the sheet is then conveyed to the double-sided conveying path 124 by a switching action of the flapper 121.

The folding processing section 400 carries out a folding process in which a sheet is folded in a Z-shape.

In the case where a large size such as an A4- or B4-size has been set as the sheet size and the folding processing section 400 has been set to carry out the folding process through an operating unit 1 of the copying apparatus 1000, the folding processing section 400 carries out the folding process on a sheet discharged from the printer section 300. In the case where the folding processing section 400 has not been set to carry out the folding process, the folding processing section 400 conveys the sheet directly to the finisher 500 without carrying out the folding process.

The inserter 900 is provided at a top of the finisher 500, for inserting a sheet such as an interleaved sheet or a cover sheet different from an ordinary sheet to any of the first page, last page, and middle page of each of a plurality of sheet bundles on which images have been formed by the printer section 300.

The finisher 500 carries out various processes such as a binding process, a staling process, and a hole-punching process (hereinafter referred to as "the punching process") on a sheet bundle including sheets conveyed from the printer section 300 via the folding processing section 400 and sheets conveyed from the inserter 900.

Figure 2A:
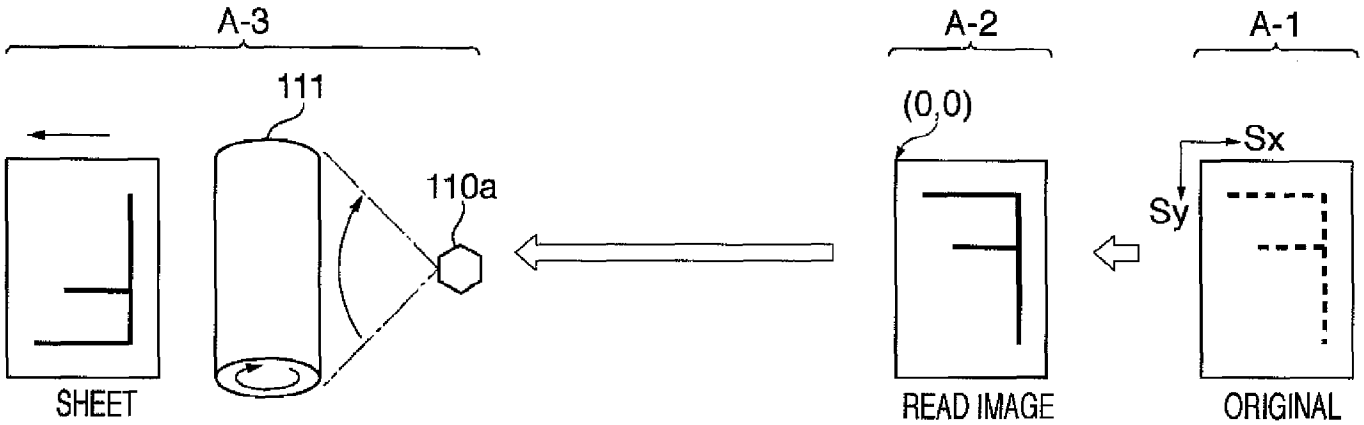
FIGS. 2A and 2B are views useful in explaining a fixed original reading method and a moving original reading method executed by a scanner unit appearing in FIG. 1.
Figure 2B:
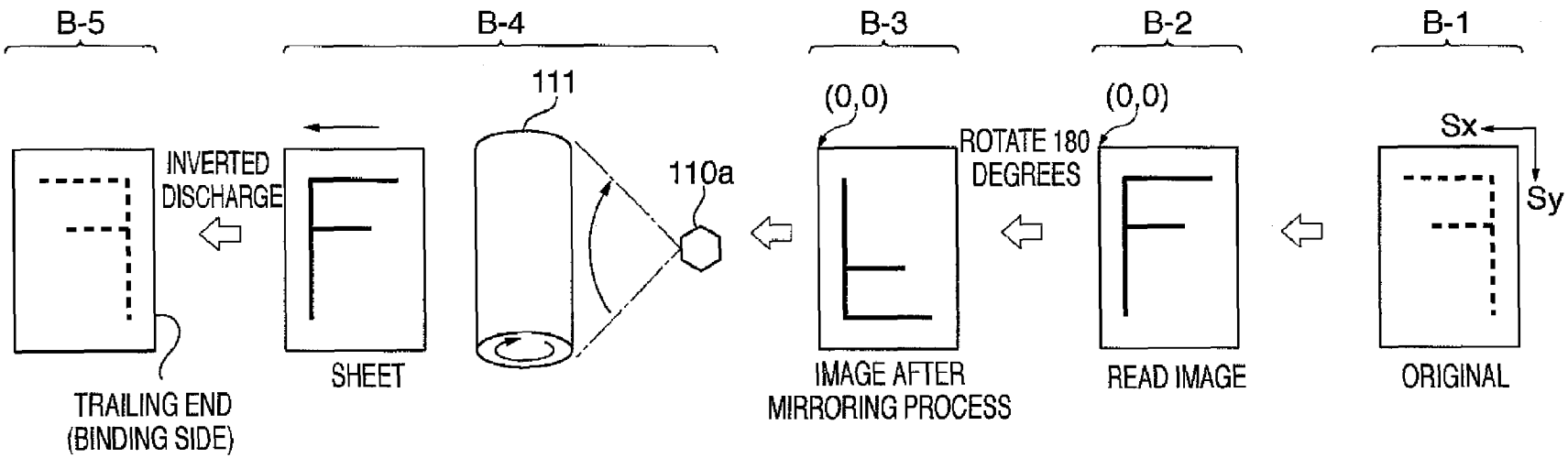

FIGS. 2A and 2B are views useful in explaining the fixed original reading method and the moving original reading method executed by the scanner unit 104 appearing in FIG. 1.

As shown in FIG. 2A, in the fixed original reading method, the scanner unit 104 carries out scanning-in of an image on an original held on the platen glass 102 in a main scanning direction Sy and a sub-scanning direction Sx ((A-1) in FIG. 2A). The image read by the image sensor 109 ((A-2) in FIG. 2A) is sequentially converted into laser light by the exposure controller 110. The polygon mirror 110*a* causes the laser light to scan the photosensitive drum 111 in a direction indicated by an arrow in FIG. 2A. As a result, an electrostatic latent image is formed on the photosensitive drum 111 ((A-3) in FIG. 2A) The electrostatic latent image formed on the photosensitive drum 111 is developed by toners and transferred onto a sheet.

In the moving original reading method, the scanner unit 104 carries out scanning-in of an image on an original being conveyed from left to right on the platen glass 102 as viewed in FIG. 1 in a main scanning direction Sy and a sub-scanning direction Sx ((B-1) in FIG. 2B). The image read by the image sensor 109 ((A-2) in FIG. 2A) is sub-scanned in a direction opposite to the direction in which an image is sub-scanned in the fixed original reading method ((B-2) in FIG. 2B). Thus, the image read by the image sensor 109 is a mirror image of the original image and therefore has to be corrected to a normal mage on a line-by-line basis.

Accordingly, in the moving original reading method, a mirroring process in which the image read by the image sensor 109 is inverted on a line-by-line basis with respect to the main scanning direction thereof is carried out so as to convert the read image to a normal image. Thus, a normal image can be obtained by rotating the original image 180 degrees and carrying out the mirroring process on the read image (B-3) in FIG. 2B).

Laser light is modulated by the exposure controller 110 based on the normal image obtained by the mirroring process and caused to scan the photosensitive drum 111 in a direction indicated by an arrow in FIG. 2B. As a result, an electrostatic latent image is formed on the photosensitive drum 111 ((B-4) in FIG. 2B). The electrostatic latent image formed on the photosensitive drum 111 is developed by toners and transferred onto a sheet.

The printer section 300 then inverts the sheet with the image has been fixed thereon and discharges the sheet with the image formed thereon in the face-down state to the folding processing section 400 ((B-5) in FIG. 2B).

Next, a stapler 601, described later, of the finisher 500 appearing in FIG. 5 staples the inverted sheet at a trailing end thereof, i.e. on a left side of the surface on which the image is formed.

It should be noted that the mirroring process may be carried out by inverting a sheet with respect to the sub-scanning direction, but in this case, the mirroring process cannot be started unless reading of an image on one page of originals is completed. Also, since an image is not rotated 180 degrees when a sheet with the image formed thereon is inverted with respect to the sub-scanning direction, the sheet discharged in the face-down state is stapled at a trailing end thereof, i.e. a right end of a surface on which an image is formed. For this reason, the mirroring process in which sheets are inverted with respect to the main scanning direction is more preferable than the mirroring process in which sheets are inverted with respect to the sub-scanning direction.

Figure 3:
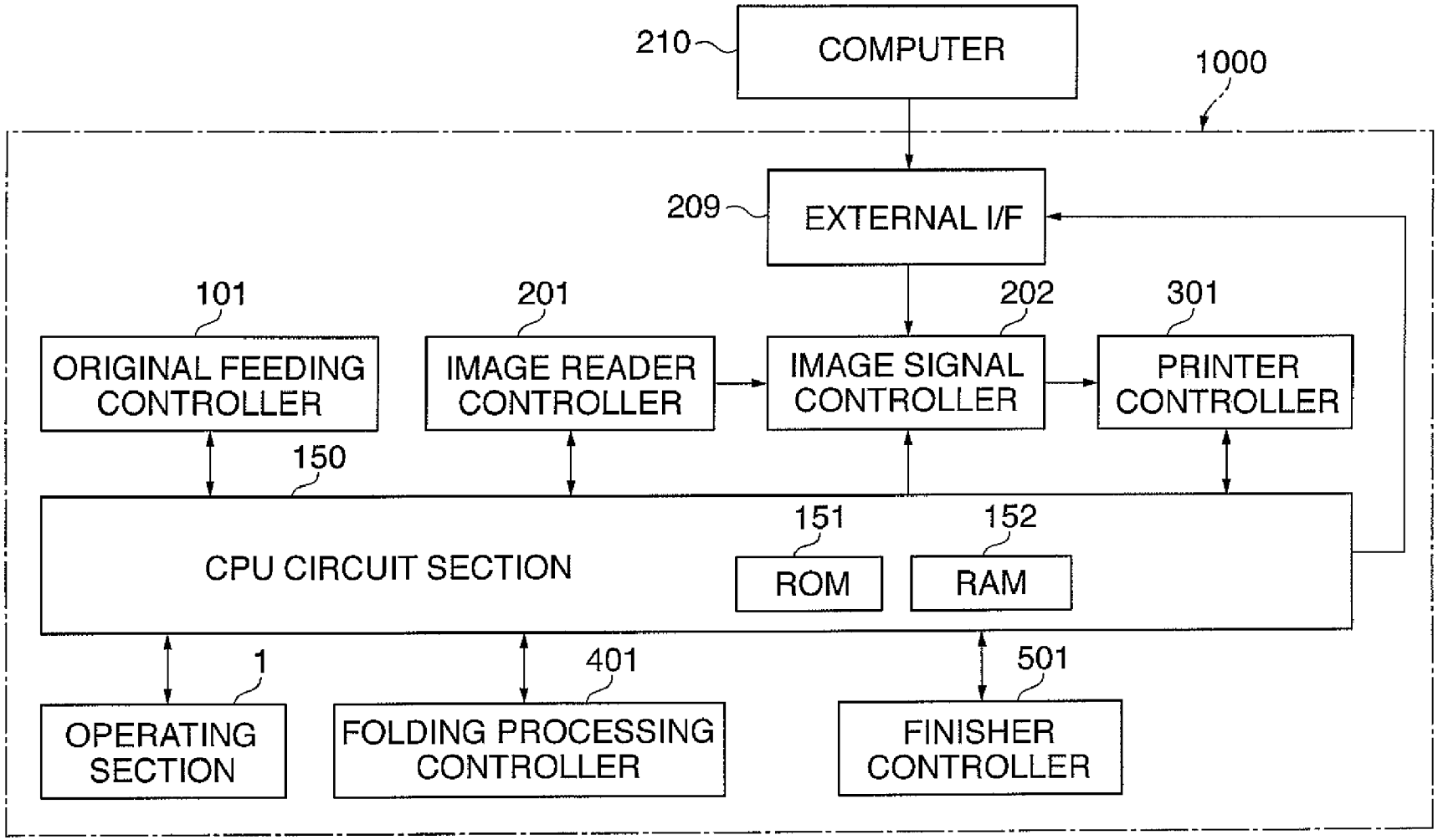
FIG. 3 is a block diagram schematically showing the construction of a copying apparatus appearing in FIG. 1.

FIG. 3 is a block diagram schematically showing the construction of the copying apparatus 1000 appearing in FIG. 1.

As shown in FIG. 3, the copying apparatus 1000 includes an original feeder controller 101, an image reader controller 201, a printer controller 301, a folding processing controller 401, a finisher controller 501, a CPU circuit section 150, and the operating section 1. The CPU circuit section 150 sends and receives signals to and from the original feeder controller 101, the image reader controller 201, the printer controller 301, the folding processing controller 401, and the finisher controller 501.

The copying apparatus 1000 also includes an external I/F 209 and an image signal controller 202. The external I/F 209 receives signals from the CPU circuit section 150 and an external computer 210. The image signal controller 202 receives signals from the image reader controller 201, the CPU circuit section 150, and the external I/F 209 and sends signals to the printer controller 301.

The CPU circuit section 150 includes a CPU, not shown, a ROM 151 that stores control programs, and a RAM 152 that is used as an area for temporarily storing control data or a working area for computations associated with control. Based on the control programs and the signals from the operating section 1, the CPU circuit section 150 controls the original feeder controller 101, the image reader controller 201, the image signal controller 202, the printer controller 301, the folding processing controller 401, the finisher controller 501, and the external I/F 209.

The original feeder controller 101 controls the original feeder 100, the image reader controller 201 controls the image reader section 200, the printer controller 301 controls the printer section 300, the folding processing controller 401 controls the folding processing section 400, and the finisher controller 501 controls the finisher 500.

The operating section 1 includes a plurality of keys for inputting setting information related to image formation, such as operation modes and sheet sizes, and a display panel. The operating section 1 sends inputted setting information to the CPU circuit section 150. Further, the operating section 1 receives a signal sent from the CPU circuit section 150 and displays information corresponding to the received information, setting information, etc. on the display panel.

The external I/F 209 interfaces with the external computer 210. The external I/F 209 expands print data sent from the computer 210 into a bitmap image and outputs the bitmap image in the form of image data to the image signal controller 202.

The image reader controller 210 outputs image data of an original read by the image sensor 109 to the image signal controller 202.

The printer controller 301 outputs image data output from the image signal controller 202 to the exposure controller 110.

Figure 4:
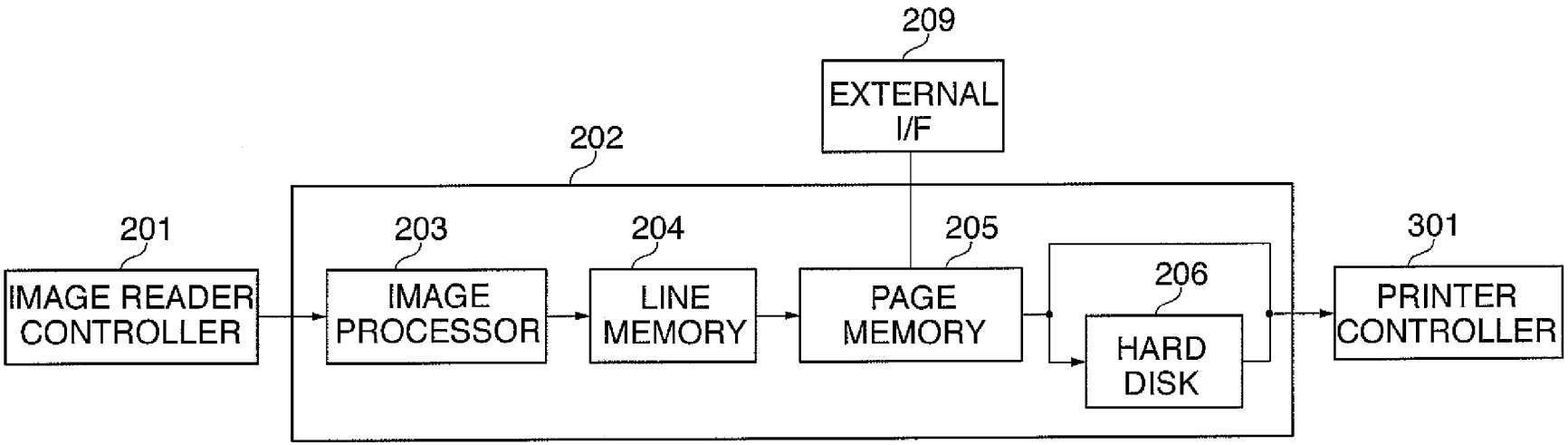
FIG. 4 is a block diagram schematically showing the construction of an image signal controller appearing in FIG. 3.

FIG. 4 is a block diagram schematically showing the construction of the image signal controller 202 appearing in FIG. 3.

In FIG. 4, reference numeral 203 denotes an image processor that carries out image correction processing required for image formation and carries out image editing processing according to an operation mode set through the operating section 1; 204, a line memory; and 205, a page memory. The image processor 203, line memory 204, and page memory 205 are connected in series. Reference numeral 206 denotes a hard disk that is used to, for example, store images and change page sequences, i.e. electronic sorting.

It should be noted that the line memory 204 is used for the above described mirroring process; images output from the line memory 204 are input to the printer controller 301 via the page memory 205.

Figure 5:
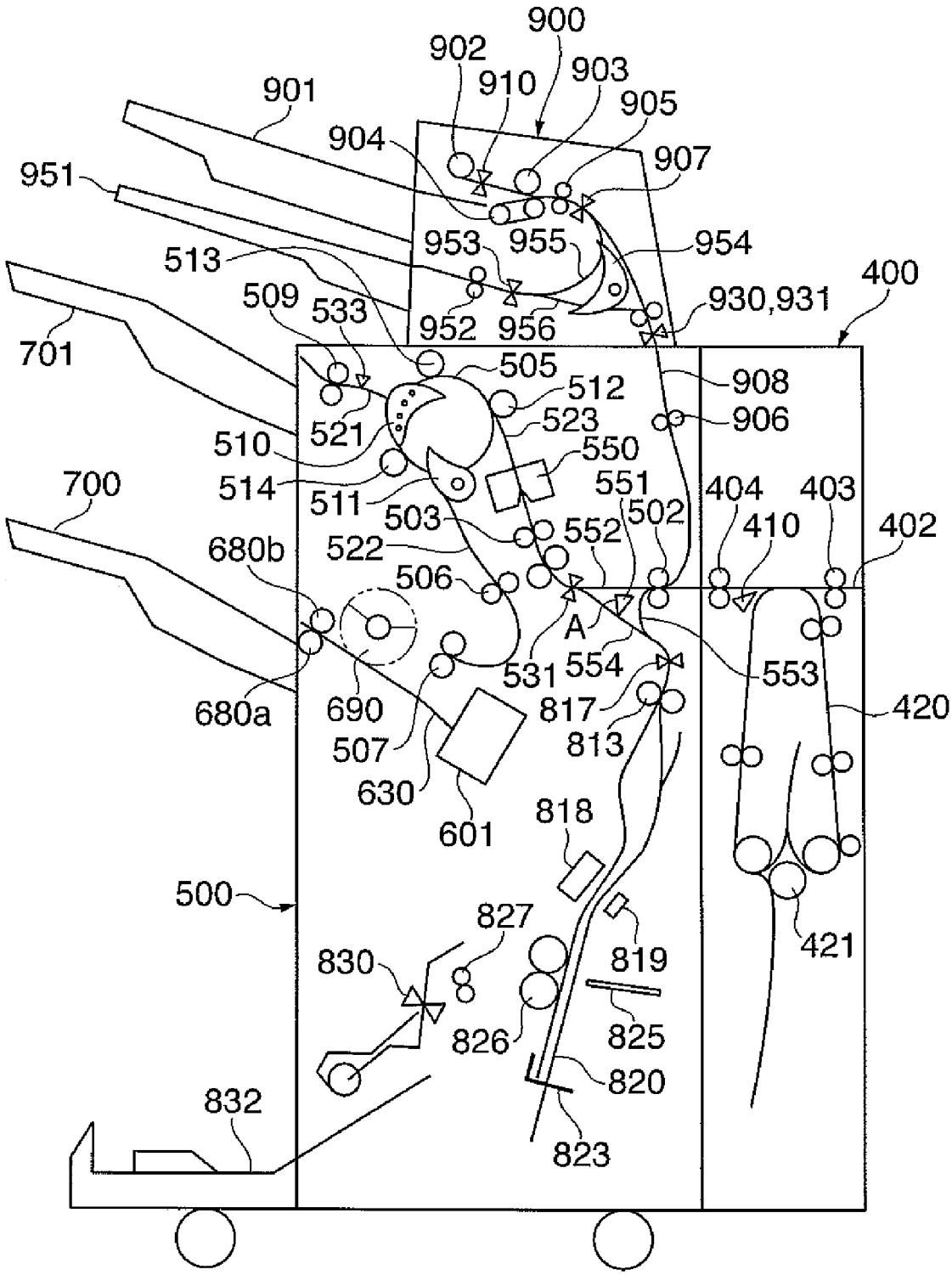
FIG. 5 is a sectional view schematically showing the constructions of a folding processing section, a finisher, and an inserter appearing in FIG. 1.

FIG. 5 is a sectional view schematically showing the constructions of the folding processing section 400, the finisher 500, and the inserter 900 appearing in FIG. 1.

In FIG. 5, reference numeral 402 denotes a conveying path that guides a sheet discharged from the printer section 300 to the finisher 500. Reference numerals 403 and 404 each denote a pair of conveying rollers provided on the conveying path 402. Reference numeral 420 denotes a folding path that is branched from the conveying path 402 between the conveying rollers 403 and 404.

Reference numeral 410 denotes a switching flapper that switches the destination of a sheet to one of the finisher 500 and the folding path 420. Reference numeral 421 denotes folding rollers provided on the folding path 420.

In the case where the folding process is carried out, the switching flapper 410 switches the destination of a sheet to the folding path 420. Thus, the sheet conveyed from the printer section 300 is conveyed to the folding rollers 421 via the folding path 420 and folded in a Z-shape.

In the case where the folding process is not carried out, the switching flapper 410 switches the destination of a sheet to the finisher 500. As a result, the sheet conveyed from the printer section 300 is conveyed to the finisher 500 via the conveying path 402.

The finisher 500 includes a path that guides a sheet conveyed from the printer section 300 via the folding processing section 400 and carries out postprocessing on the sheet.

Reference numeral 502 denotes a pair of inlet rollers that takes a sheet conveyed from the printer section 300 via the folding processing section 400 into the finisher 500. Reference numeral 552 denotes a finisher path that guides a sheet conveyed from the inlet rollers 502. Reference numeral 553 denotes a first bookbinding path branched from the finisher path 552. Reference numeral 554 denotes a second bookbinding path 554 branched from the first bookbinding path 553 toward the finisher path 522 and connected to the finisher path 552. Reference numeral 551 denotes a switching flapper that is provided at a location enclosed by the finisher path 552, the first bookbinding path 553, and the second bookbinding path 554 and selectively switches the destination of a sheet to any of the finisher path 552, the first bookbinding path 553, and the second bookbinding path 554.

Reference numeral 503 denotes a pair of conveying rollers that are rotatable forward and backward and convey a sheet guided to a finisher path 552. Reference numeral 505 denotes a buffer roller that is rotatable forward and backward and takes in a sheet conveyed by the conveying rollers 503. Reference numeral 521 denotes a non-sort path 521 branched from the sort path 522. Reference numeral 522 denotes a sort path that guides a sheet taken in by the buffer roller 505. Reference numeral 510 denotes a switching flapper that separates a sheet wound on the buffer roller 505 from the buffer roller 505 and conveys the sheet to a non-sort path 521 (non-sort processing) or selects a path so as to convey the sheet directly to the sort path 522 without separating it from the buffer roller 505. Reference numeral 509 denotes a pair of discharge rollers provided on the non-sort path 521. Reference numeral 533 denotes a discharged sheet sensor provided between the switching flapper 510 and the pair of discharge rollers 509, for detecting jamming or the like. Reference numeral 531 denotes an inlet sensor provided between the pair of inlet rollers 502 and the pair of conveying rollers 503. A predetermined number of sheets conveyed from the conveying rollers 503 are wound on the buffer roller 505 by depressing rollers 512, 513, and 514 provided on a rotating surface of the buffer roller 505 as the buffer roller 505 rotates. A sheet conveyed to the non-sort path 521 by the switching flapper 510 is discharged onto a sample tray 701 via the pair of discharge rollers 509.

Reference numeral 506 and 507 denote a pair of conveying rollers and a pair of discharge rollers, respectively, that convey a sheet guided to the sort path 522 by the switching flapper 510. Reference numeral 630 denotes an intermediate tray (hereinafter referred to as "the processing tray") on which conveyed sheets are staked in the form of a bundle. A bundle of sheets on the processing tray 630 is aligned in the stacking direction thereof and stapled according to e.g. an operation mode set through the operating section 1. Reference numeral 601 denotes the stapler that staples a group of sheets stacked in the form of a bundle on the processing tray 630. Reference numerals 680*a* and 680*b* denote discharge rollers that convey a group of sheets having been aligned and stapled. Reference numeral 700 denotes a vertically free-running stack tray onto which a group of sheets having been conveyed is discharged. Reference numeral 550 denotes a punch unit including a punch roller comprised of a die section and a punch section. The punch unit 550 operates in accordance with e.g. an operation mode set through the operating section 1 and carries out the punching process in which a hole is punched in an area at the trailing end of a sheet conveyed from the inserter 900 or the printer section 300 via the conveying rollers 503.

In punching a sheet, the punch unit 550 causes the punch roller to rotate 360 degrees when the trailing end of the sheet reaches the punch unit 550, thereby making a punch hole at the trailing end of the sheet. It should be noted that in consideration of productivity and cost, the punching is carried out with respect to each sheet as the sheet is conveyed.

In the following description, a point of branch to the finisher path 552 and the second bookbinding path 554 will be referred to as "the branch A."

A sheet conveyed from the inlet rollers 502 is conveyed toward the conveying rollers 503 by the switching flapper 551. Thereafter, when the conveying rollers 503 are rotated backward, the sheet is conveyed toward the second bookbinding path 554 by the switching flapper 551, not toward the inlet rollers 502. That is, the switching flapper 551 is provided with a one-way mechanism that limits the sheet conveying direction. This mechanism causes a sheet on the finisher path 552 in only a direction from right to left as viewed in FIG. 5 and on the second bookbinding path 554 only in a direction from top to bottom as viewed in FIG. 5.

Reference numeral 817 denotes a bookbinding inlet sensor that detects the passage of a sheet guided into the first bookbinding path 553. Reference numeral 813 denotes a pair of bookbinding rollers that convey a sheet having passed through the bookbinding inlet sensor 817. Reference numeral 820 denotes a housing guide that houses conveyed sheets. Reference numeral 823 denotes a movable sheet positioning member onto which the leading end of a sheet comes into contact so that the sheet is positioned. Reference numeral 818 denotes two pairs of staplers. Reference numeral 819 denotes an anvil provided in opposed relation to the staplers 818 with the housing guide 820 interposed therebetween. The staplers 818 cooperate with the anvil 819 to staple a bundle of sheets at the center thereof.

Reference numeral 826 denotes a pair of folding rollers provided below the staplers 818 as viewed in FIG. 5. Reference numeral 825 denotes a projecting member provided in opposed relation to the folding rollers 826 with the housing guide 820 interposed therebetween. The projecting member 825 projects toward a bundle of sheets housed in the housing guide 820 to push out the bundle of sheets into a space between the folding rollers 826. The folding rollers 826 carry out folding processing in which the pushed-out sheets are folded. In carrying out the folding process on a bundle of sheets stapled by the staplers 818, the stapled position of the sheet bundle is caused to mach the central position (nip point) of the folding rollers 816. To this end, the sheet positioning member 823 is caused to move down a predetermined distance from the position at which it lies during stapling. Thereafter, the sheet bundle is folded with the stapled position at the nucleus.

Reference numeral 827 denotes a pair of sheet discharge rollers that guide a folded sheet bundle. Reference numeral 830 denotes a book-bound discharged sheet sensor that detects the passage of a sheet bundle guided by the sheet output rollers 827. Reference numeral 813 denotes a discharge tray onto which a sheet bundle having passed through the book-bound discharged sheet sensor 830 is discharged.

The inserter 900 feeds sheets stacked on an insert tray 901 to any of the sample tray 701, stack tray 700, and output tray 832 via the finisher path 522 or the bookbinding path 553 without passing the sheets through the printer section 300.

It should be noted that in the present embodiment, the user stacks cover sheets or interleaved sheets in the face-up state on the insert tray 901, described later.

Reference numeral 901 denotes the insert tray on which a sheet bundle is stacked. Reference numeral 904 denotes a separation belt that sequentially separates sheets one by one from the top one from the stacked sheet bundle. Reference numeral 903 denotes a separation roller that conveys separated sheets and constitutes a separating section together with the separation belt 904. Reference numeral 905 denotes a pair of pull-out rollers provided in the vicinity of the separating section; 908, a conveying path that guides a sheet conveyed from the pullout rollers; and 906, a pair of conveying rollers that convey a sheet guided on the conveying path 908 to the inlet rollers 502. Reference numeral 955 denotes an inversion path branched from the conveying path 908, and reference numeral 956 denotes a path that branches from the inverted path 955 toward the conveying path 908 and is connected to the conveying path 908. Reference numeral 954 denotes a flapper that selectively switches the destination of a sheet to the conveying path 908, inversion path 955, and path 956. In the case where a sheet on the insert tray 901 is fed in an inverted state, the sheet is from the pull-out rollers 905 to the inversion path 955 so as to be inverted.

Reference numeral 952 denotes a pair of inversion rollers that are rotatable forward and backward and convey a sheet conveyed via the inversion path 955. Reference numeral 951 denotes a tray onto which a sheet conveyed by the inversion rollers 952 is temporarily discharged. When the conveying direction of the inversion rollers 952 is reversed, a sheet is conveyed to the conveying path 908.

Reference numeral 910 denotes a sheet set sensor provided between a sheet feed roller 902 and the separation roller 903, for detecting whether or not a sheet has been set. Reference numeral 907 denotes a sheet feed sensor provided in the vicinity of the drawing rollers 905, for detecting whether or not a sheet has been conveyed by the drawing rollers 905. Reference numeral 953 denotes a set sensor provided between the sheet feed sensor 907 and the inversion rollers 952, for detecting whether or not a sheet has passed so as to determine whether or not the sheet has been guided into the inversion path 955. Reference numerals 930 and 931 denote skew sensors provided at different locations downstream of the sheet feed sensor 907 and on the same line orthogonal to the sheet conveying direction. The skew sensors 930 and 931 are used to detect the skewed amount (tilted amount) of a sheet fed from the insert tray 901 of the inserter 900.

In the vicinity of and at a location upstream of the inlet rollers 502, the conveying path 908 joins the conveying path 402 that guides a sheet from the printer section 300.

Figure 6:
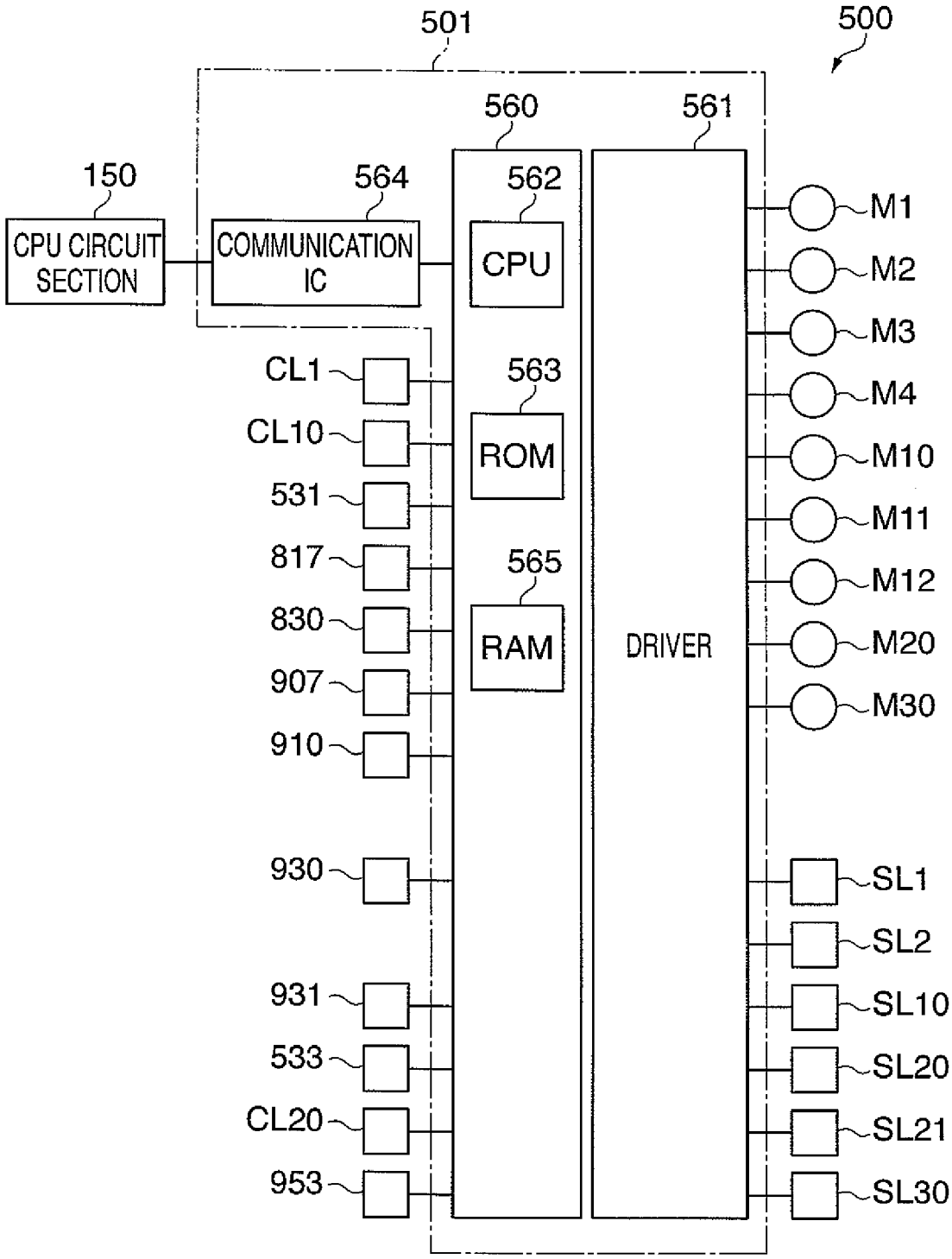
FIG. 6 is a block diagram schematically showing the construction of the finisher appearing in FIG. 3.

Referring next to FIG. 6, a description will be given of the construction of the finisher controller 501 that drivingly controls the finisher 500.

FIG. 6 is a block diagram schematically showing the construction of the finisher controller 501 appearing in FIG. 3.

In FIG. 6, reference numeral 560 denotes a CPU circuit section that is comprised of a CPU 562, a ROM 563 storing various programs, and a RAM 565. Reference numeral 561 denotes a driver connected to the CPU circuit section 560, and reference numeral 564 denotes communication IC connected to the CPU circuit section 150 and the CPU circuit section 560 in the copying apparatus 1000.

The CPU circuit section 560 carries out communication with the CPU circuit section 150 of the copying apparatus 1000 via the communication IC 564. Also, the CPU circuit section 560 drivingly controls the finisher 500 by executing various programs stored in the ROM 563 in accordance with instructions from the CPU circuit section 150.

When the CPU circuit section 560 drivingly controls the finisher 500, detection signals sent from various sensors are input to the CPU circuit section 560.

The above-mentioned sensors include the inlet sensor 531, the bookbinding inlet sensor 817, the book-bound discharged sheet sensor 830, the sheet feed sensor 907, the sheet set sensor 910, the discharged sheet sensor 533, the skew sensor 930 and 931, and the set sensor 953 (FIG. 5).

The driver 561 drives various motors, solenoids, a clutch CL1, a clutch CL10, a clutch CL20, and so forth in accordance with signals from the CPU circuit section 560.

The above-mentioned motors include an inlet motor M1, a buffer motor M2, a sheet discharge motor M3, a bundle discharge motor M4, a conveying motor M10, a positioning motor M11, a folding motor M12, a sheet feed motor M20, and a punch motor M30.

The inlet motor M1 drives the inlet rollers 502, the conveying rollers 503, and the conveying rollers 906. The buffer motor M2 drives the buffer roller 505. The sheet discharge motor M3 drives the conveying rollers 506, the discharge rollers 507, and the discharge rollers 509. The bundle discharge motor M4 drives the discharge rollers 680*a* and 680*b*. The conveying motor M10 drives the bookbinding rollers 813. The positioning motor M11 drives the sheet positioning member 823. The folding motor M12 drives the projecting member 825, the folding rollers 816, and the sheet discharge rollers 827. The sheet discharge motor M20 drives the sheet feed roller 902, the separation roller 903, the separation belt 904, drawing rollers 905, and the inversion rollers 952, which are provided in the inserter 900. The punch motor M30 drives the punch roller within the punch unit 550.

The direction in which the inversion rollers 952 are driven by the sheet feed motor M20 is changed by the clutch CL20 so that the inversion rollers 952 rotate forward when conveying a sheet in an advancing state and rotated backward when conveying a sheet in an inverted state.

The inlet motor M1, the buffer motor M2, and the sheet discharge motor M3 are each implemented by a stepping motor. By controlling the excitation pulse rate of current input to each motor, the rollers driven by the motor can be rotated with a uniform speed or different speeds.

The inlet motor M1 and the buffer motor M2 are caused to freely rotate forward and backward by the driver 561.

The conveying motor M10, the positioning motor M11, and the sheet feed motor M20 are each implemented by a stepping motor, and the folding motor M12 is implemented by a DC motor.

The conveying motor M10 and the sheet feed motor M20 are configured to convey a sheet in synchronization with the inlet motor M1.

The above-mentioned solenoids include a solenoid SL1, SL2, SL10, SL20, SL21, and SL30. The solenoid SL1 selectively changes the position of the switching flapper 510. The solenoid SL2 selectively changes the position of the switching flapper 511. The solenoid SL10 selectively changes the position of the switching flapper 551. The solenoid SL20 drives a sheet feed shutter, not shown, of the inserter 900. The solenoid SL21 drives the sheet feed roller 902 of the inserter 900 to move up and down. The solenoid SL30 drives the flapper 954 of the inserter 900.

A description will now be given of how an operation mode is set.

Figure 7A:
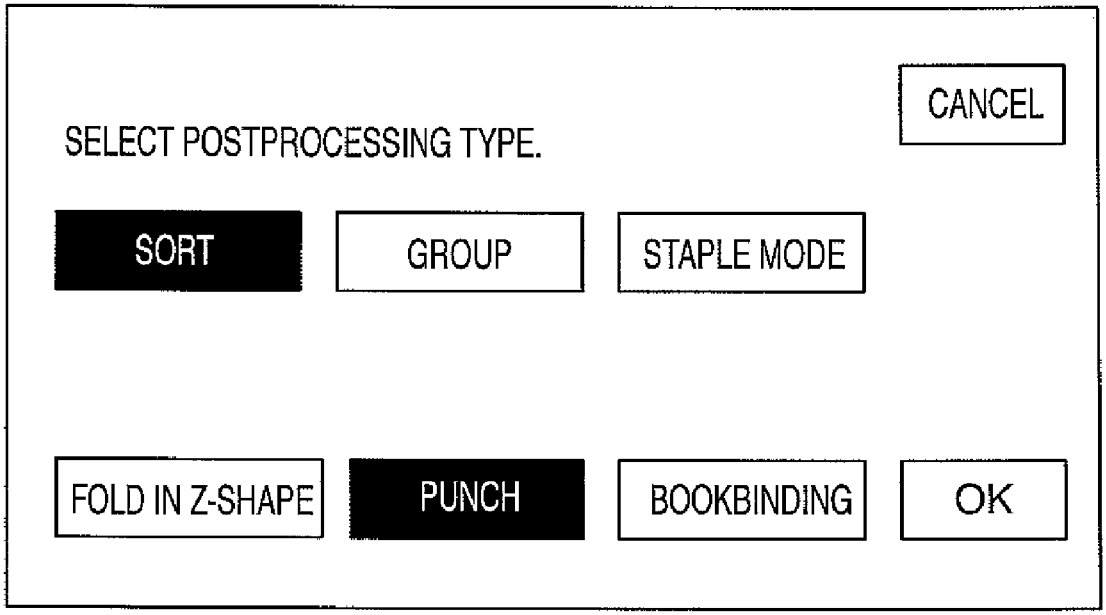
FIG. 7A is a view showing an example of a postprocessing selection menu screen displayed on a display panel of an operating unit of the copying apparatus appearing in FIG. 1.
Figure 7B:
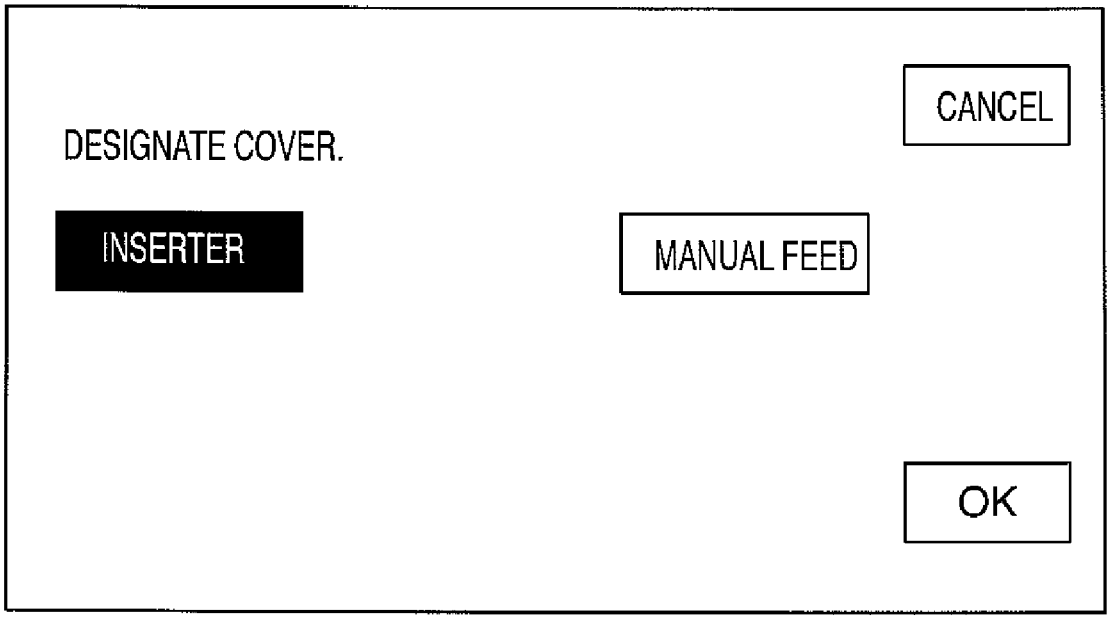
FIG. 7B is a view showing an example of a cover designation menu screen displayed on the display panel of the operating unit.

FIG. 7A is a view showing an example of a postprocessing selection menu screen displayed on a display panel of the operating section 1 of the copying apparatus appearing in FIG. 1, and FIG. 7B is a view showing an example of a cover designation menu screen displayed on the display panel of the operating section 1.

The display panel in FIGS. 7A and 7B has a touch-sensitive panel on a surface thereof. When an operator touches a box in which a function name is displayed on the screen displayed on the display panel, processing corresponding to the touched function name is carried out.

In FIG. 7A, the display panel displays the postprocessing selection menu screen. By way of this screen, the user can select any of a non-sort mode, a sort mode, a staple sort mode (binding mode), a punch mode (hole-punching mode), a bookbinding mode, and so forth, which are operation modes of postprocessing.

In FIG. 7B, the display panel displays the cover sheet designation menu screen. By way of this screen, the user can determine whether a sheet to be inserted is to be fed from the inserter 900 or fed manually. Further, the user can select any of a front cover mode, an interleaving sheet mode, and a back cover mode, which are sheet insertion modes, not shown. The user can select either of the insert tray 901 and the manual sheet feed section 125 as a first stacking section with respect to each insertion mode. It should be noted that the front cover mode is a mode in which a sheet placed on the inserter 900 or the manual sheet feed section 125 is inserted to the first page of sheets conveyed from the printer section 300. The interleaving sheet mode is a mode in which sheets stacked on the inserter 900 or the manual sheet feed section 125 are inserted as dividers for use as interleaved sheets. The back cover mode is a mode in which a sheet placed on the inserter 900 or the manual sheet feed section 125 is inserted to the last page of sheets conveyed from the printer section 300.

Referring next to FIGS. 8 and 12, a description will be given of the flow of a sheet when it is housed on the processing tray 630 in the case where the bookbinding mode is not set.

Figure 8A:
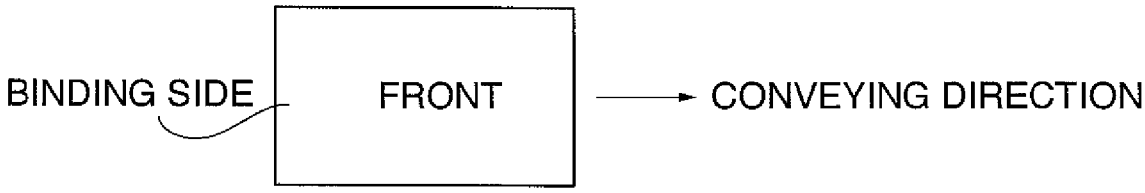
FIG. 8A is a view showing a direction in which sheets stacked on an insert tray appearing in FIG. 5 are conveyed.
Figure 8B:
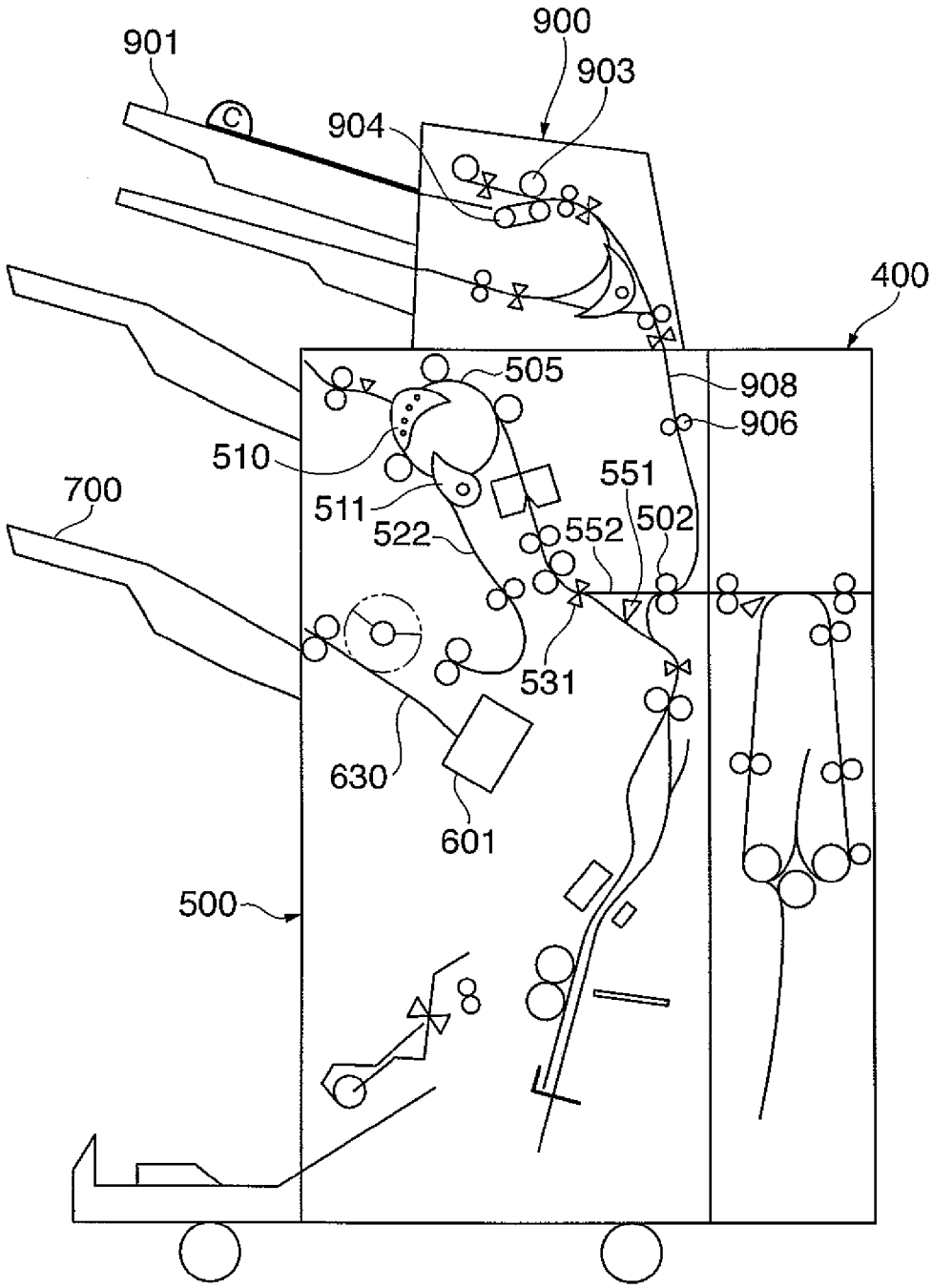

FIG. 8A is a view showing a direction in which sheets stacked on the insert tray 901 appearing in FIG. 5 are conveyed, and FIG. 8B is a view showing a state in which sheets are stacked on the insert tray 901 of the inserter 900.

In the present embodiment, it is assumed that a sheet (sheet for use as a front cover) conveyed from the inserter 900 and two sheets conveyed from the printer section 300, i.e. a total of three sheets are housed as one set on the processing tray 630.

In FIG. 8B, a semicircular mark is written on the front side of a sheet so as to differentiate between the front and back sides of the sheet, and a sheet number or image number is written in the mark.

Figure 9:
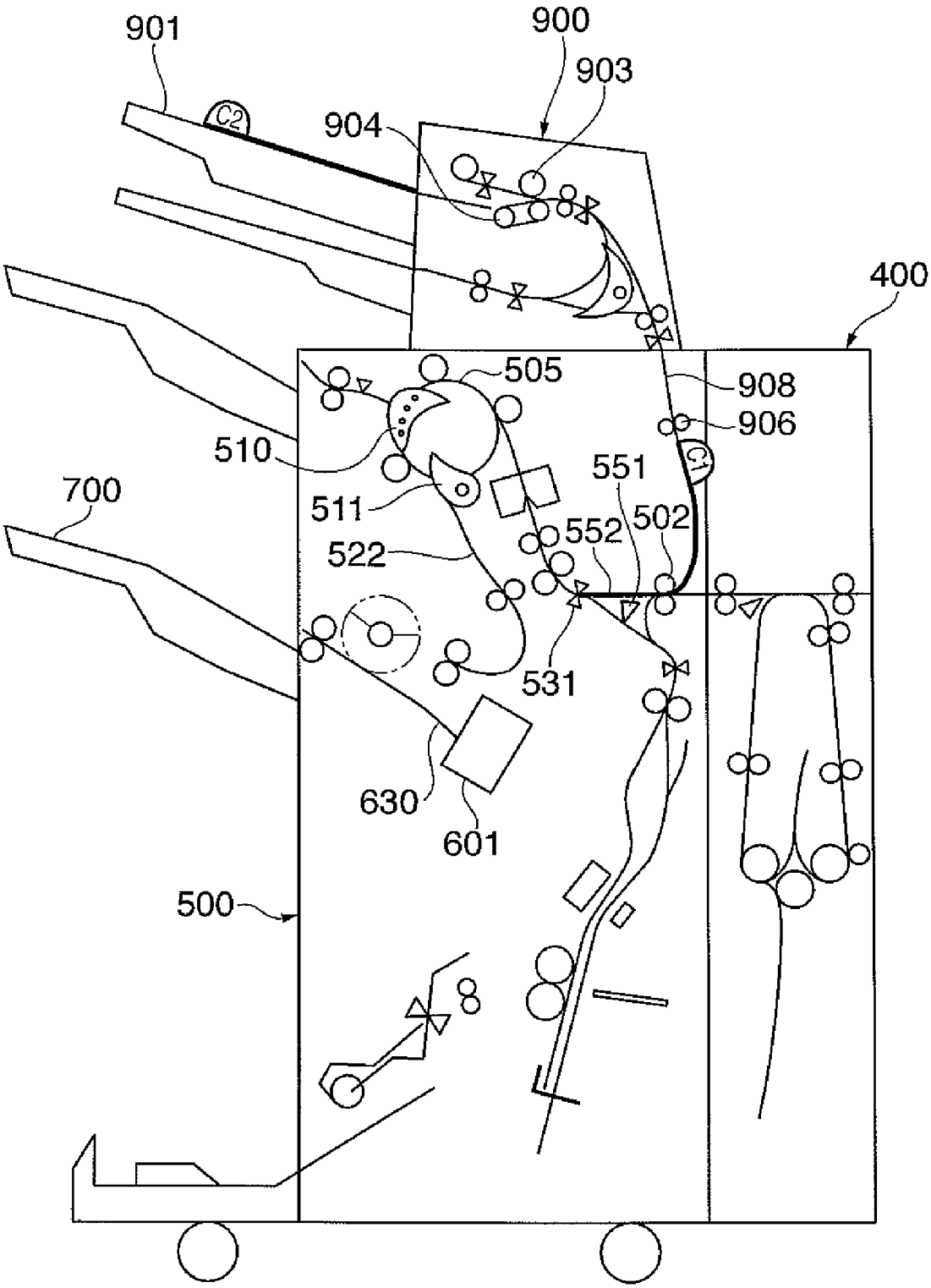
FIG. 9 is a view useful in explaining a sheet C1 guided to a conveying path in the finisher appearing in FIG. 8.

In the case where a sheet of a sheet bundle C on the insert tray 901 is inserted as a cover sheet, the user stacks the sheet bundle in the face-up state and in an erected image on the insert tray 901 as shown on the left side of FIG. 8A (FIG. 8B). First, a start key, not shown, provided on the operating section 1 is depressed. In response to the depression of the start key, the uppermost sheet of the sheet bundle C (hereinafter referred to as "the sheet C1") is separated from the sheet bundle C and conveyed to the conveying path 908 (FIG. 9). At this time, since the switching flapper 551 has switched the path to the finisher path 552, the sheet C1 is conveyed in the face-down state toward the buffer roller 505 by the inlet rollers 502.

On the other hand, the printer section 300 converts an image read using the moving original reading method into a normal image by carrying out the mirroring process, forms the resulting image on a sheet, and discharges the sheet in the face-down state toward the finisher 500.

Figure 10:
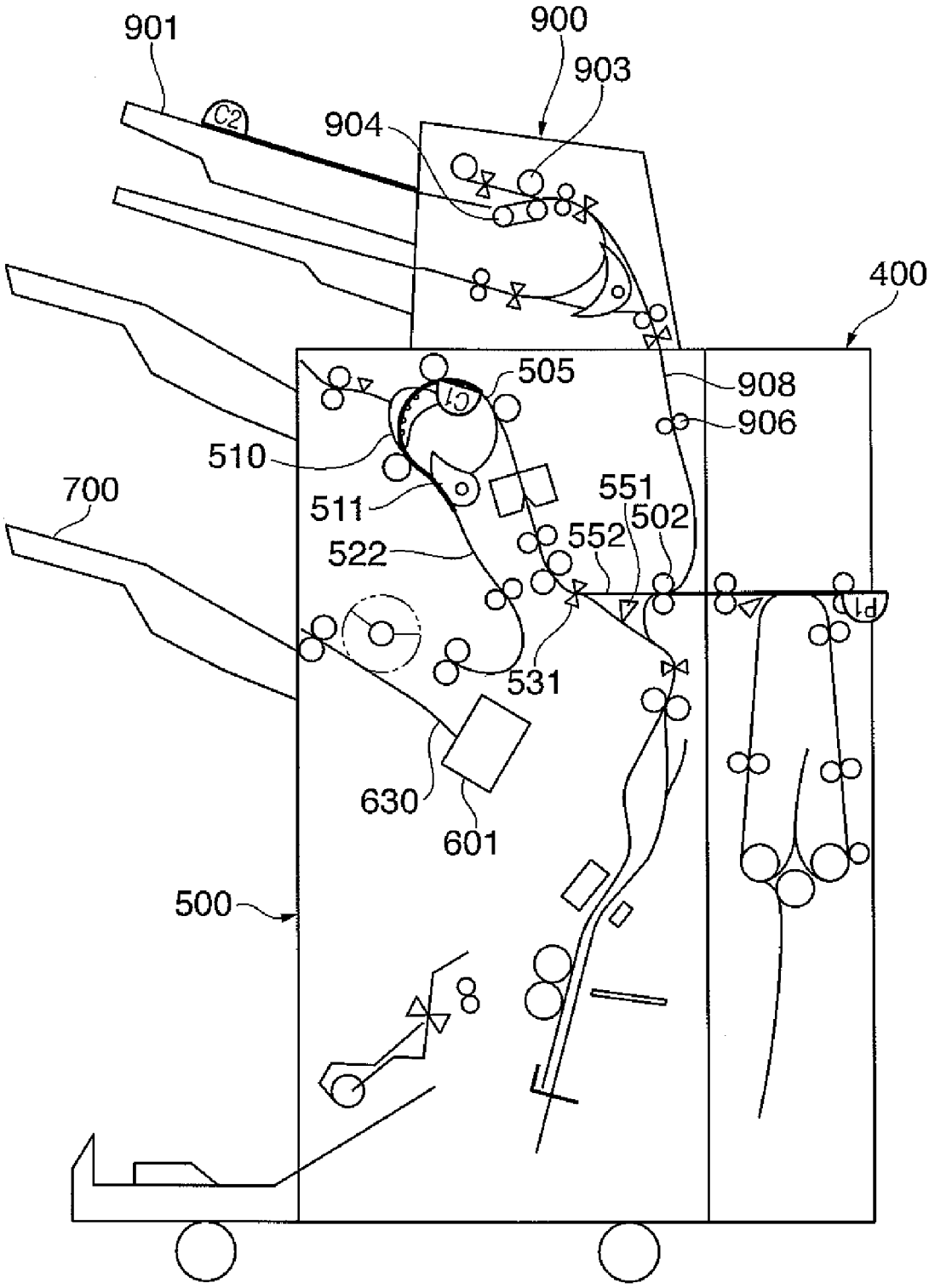
FIG. 10 is a view useful in explaining a sheet P1 conveyed to the finisher appearing in FIG. 8.

The sheet P1 thus discharged from the printer section 300 is conveyed into the finisher 500 after the leading end of the sheet C1 conveyed by the inlet rollers 502 passes the inlet sensor 531, i.e. after the inlet sensor 531 is turned on (FIG. 10).

Both of the switching flapper 510 and 511 switch the path to the sort path 522. The sheet C1 conveyed to the buffer roller 505 is conveyed to the sort path 522, and following the sheet C1, the sheet P1 conveyed from the printer section 300 is conveyed in the face-down state into the finisher 500.

Figure 11:
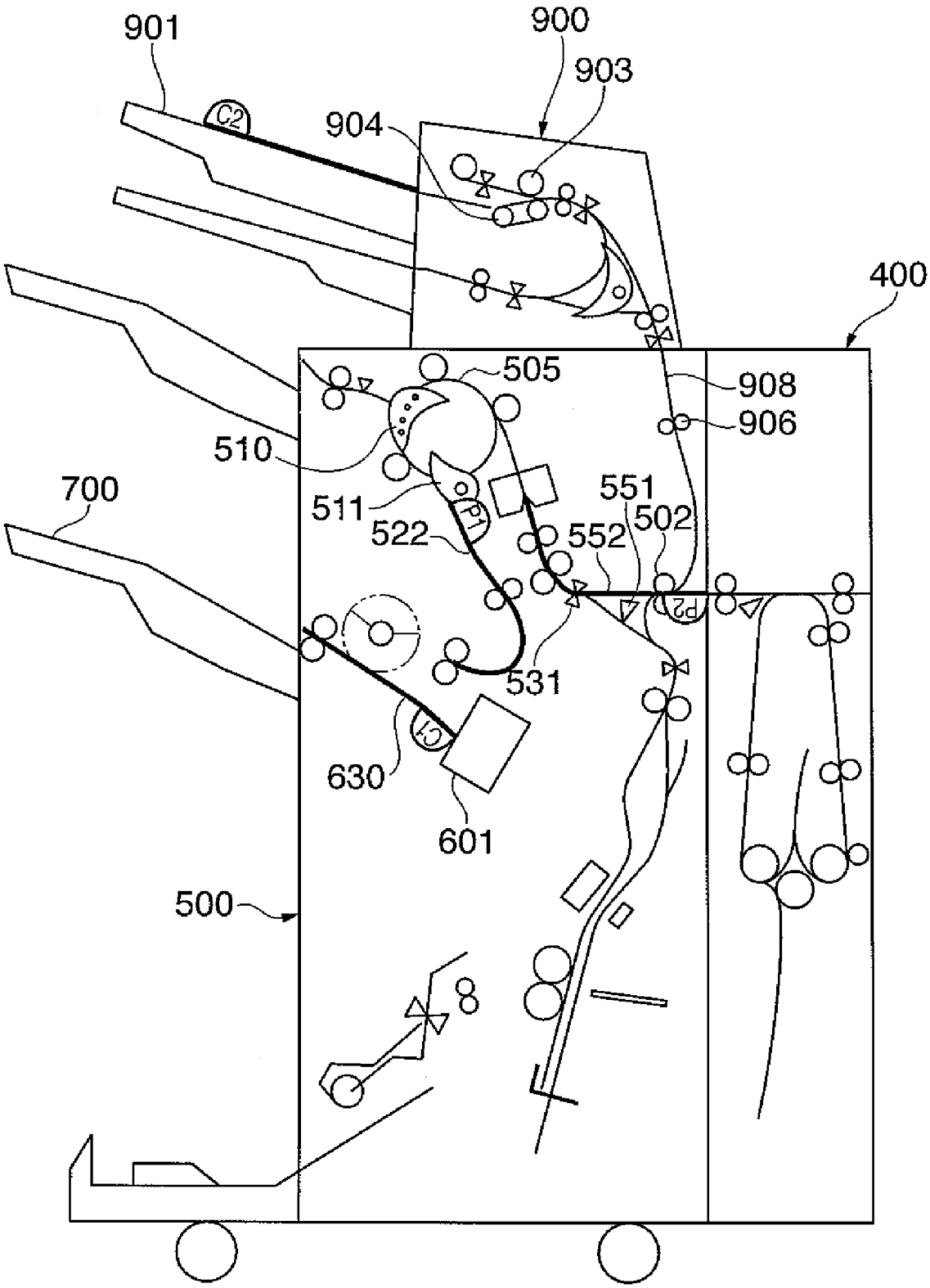
FIG. 11 is a view useful in explaining the sheet C1 conveyed to a processing tray of the finisher appearing in FIG. 8.

The sheet C1 conveyed to the sort path 522 is conveyed to the processing tray 630 (FIG. 11) The sheet P1 conveyed from the printer section 300 into the finisher 500 following the sheet C1 is conveyed to the sort path 522 via the finisher path 552 and the buffer roller 505.

At this time, conveyance of a sheet P2 from the printer section 300 to the finisher 500 is started following the conveyance of the sheet P1.

In outputting the second set, a sheet which follows the uppermost sheet C1 of the sheet bundle C stacked on the insert tray 901 (hereinafter referred to as "the sheet C2") is separated from the sheet bundle C by the separating section of the inserter 900 so as to be used as a front cover of the second set.

Next, the sheet C1 is housed in on the processing tray 630 in such a manner that the sheet C1 lies in the face-down state with the binding position thereof on the stapler 601 side. The sheet P2 following the sheet C1 is conveyed to the processing tray 630 as is the case with the sheet C1 and housed on the processing tray 630 where it is laid over the sheet C1.

In outputting the second set, the sheet C2 following the sheet P2 is conveyed to the conveying path 908. While the sheet P2 is being conveyed toward the processing tray 630, however, the conveyance of the sheet C2 is temporarily stopped so that the sheet C2 is at a standstill in front of the conveying rollers 906. In synchronization with timing in which the sheet P2 is housed on the processing tray 630, the conveyance of the sheet C2 is resumed.

Figure 12A:
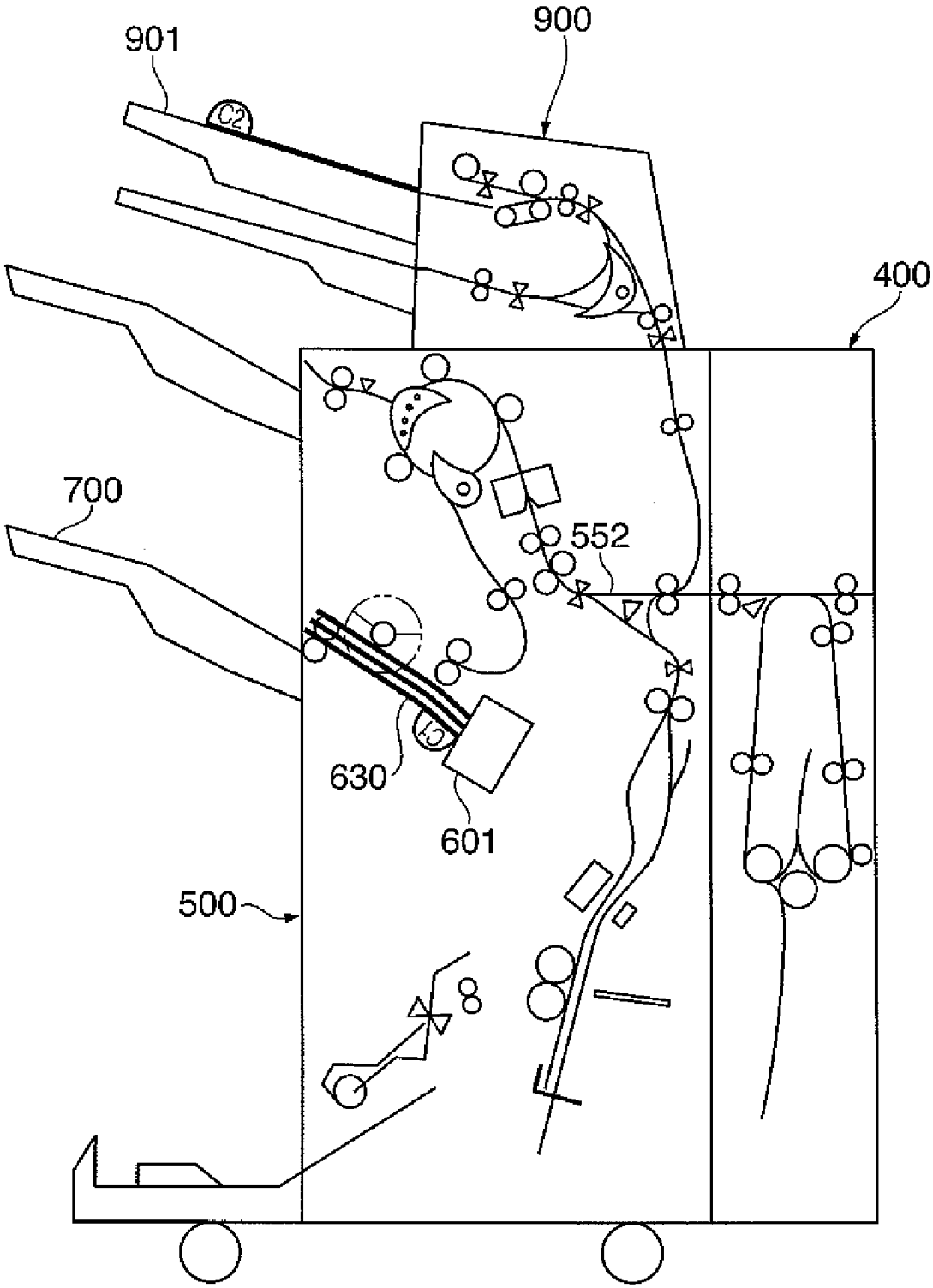
FIG. 12A is a view showing a sheet bundle stacked on the processing tray appearing in FIG. 5.
Figure 12B:
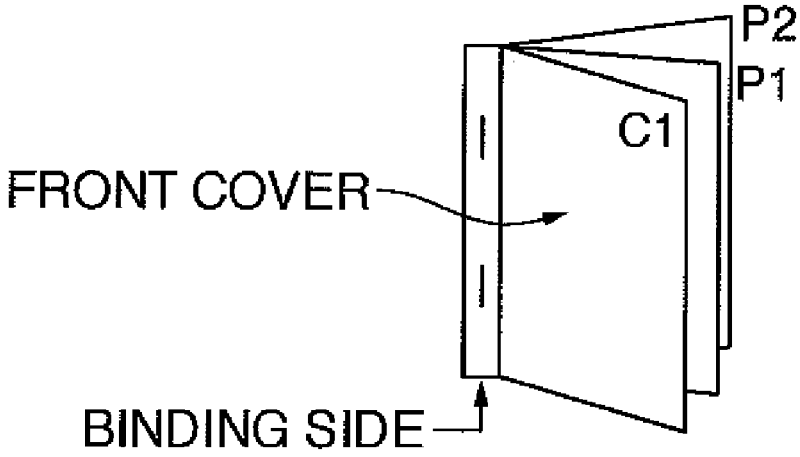
FIG. 12B is a view showing a sheet bundle of which front cover is the sheet C1.
Figure 12C:
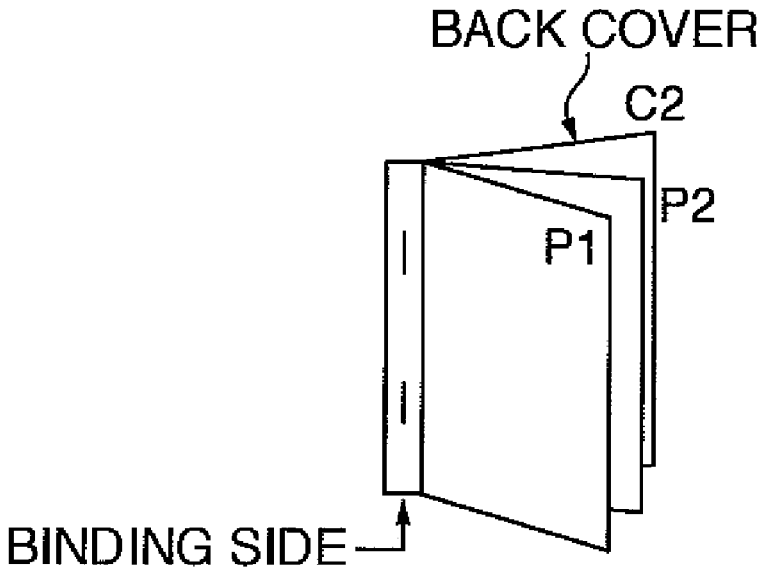
FIG. 12C is a view showing a sheet bundle of which back cover is a sheet C2.

FIG. 12A is a view showing a sheet bundle stacked on the processing tray 630 appearing in FIG. 5, FIG. 12B is a view showing a sheet bundle of which front cover is the sheet C1, and FIG. 12C is a view showing a sheet bundle of which back cover is the sheet C2.

In FIG. 12A, normal images converted from images output from the image reader section 200 by carrying out the mirroring process are formed on the sheets P1 and P2 stacked on the processing tray 630.

Also, the finisher 500 inverts sheets stacked in the inserter 900 and sheets conveyed from the printer section 300 in the face-down state to the processing tray 630. It should be noted that the conveyance of the sheets stacked in the inserter 900 is carried out prior to the conveyance of the sheets from the printer section 300.

The sheets P1 and P2 housed on the processing tray 630 lie in the face-down state with the binding positions thereof on the stapler 601 side as is the case with the sheet C1.

In the case where the stapling process is carried out as postprocessing on the sheet bundle housed on the processing tray 630, the stapling process is carried out by the stapler 601 immediately after the sheet P2 is housed on the processing tray 630. The sheets of the sheet bundle on which the stapling process has been carried out are identical in image orientation and binding position and book-bound as shown in FIG. 12B.

In this way, the finisher 500 can carry out first-page processing, in which sheets conveyed from the inserter 900 and sheets conveyed from the printer section 300 are collated when they are mixed, and postprocessing in a compatible manner. Also, in the case where postprocessing is carried out on the mixed sheet bundle, the alignment of the sheets can be facilitated, which prevents the occurrence of troubles.

If the orientation of originals (front, back, top and tail) stacked on the tray 1001 and the orientation of sheets (front, back, top and tail) stacked on the insert tray 901 are made identical, formed images and inserted sheets can be identical in orientation. Thus, originals may be stacked in the erected image and in the face-up state so that the user can easily stack them, and therefore it is possible to prevent the orientations of inserted sheets and formed images from becoming inappropriate and to improve the ease of operation.

Further, since the original feeder 100 and the inserter 900 are constructed such that the direction in which originals stacked on the tray 1001 are fed (from right to left as viewed in FIG. 1) and the direction in which sheets stacked on the insert tray 901 are fed (from left to right as viewed in FIG. 1) are opposite to each other, and the tray 1001 and the insert tray 901 face externally from the copying system 2000, the copying system 2000 can be made compact. Also, the ease of stacking in the inserter 900 can be improved.

Although in the present embodiment, the printer section 300 forms output images on sheets, the present invention is not limited to this, but images input from the external computer 210 may be formed on sheets. In this case as well, rotation processing such as mirroring is carried out on images input from the external computer 210 as necessary in consideration of image orientations and binding positions of sheets stacked on the insert tray 901. Then, the images on which such processing has been carried out are formed on the sheets, and the sheets with the images formed thereon are inverted and discharged to the finisher 500.

In the description of the present embodiment, it is assumed that the front cover mode in which a sheet placed on the insert tray 901 is inserted to the first page of sheets conveyed from the printer section 300 is set. The same process is carried out in the case where the interleaving sheet mode in which sheets stacked on the insert tray 901 are inserted as dividers for use as interleaved sheets to middle pages of sheets conveyed from the printer section 300 is set and the case where the back cover mode in which a sheet placed on the insert tray 901 is inserted to the last page of sheets conveyed from the printer section 300 is set. In the case where the back cover mode is set, not the sheets C1, P1, and P2 but the sheets P1, P2, and C2 are discharged to the processing tray 630. In this way, a sheet placed on the inset tray 901 or the manual sheet feed section 125 can be inserted to the last page of sheets conveyed from the printer section 300. On this occasion, the sheet C2 is conveyed to the finisher path 552 after being inverted by an inverted sheet feed process, described later, and thereafter, the same processing as in the front cover mode is carried out on the sheet C2. In the case where the stapling process is carried out, the sheets are bound as shown in FIG. 12C.

Although in the present embodiment, sheets stacked on the insert tray 901 are inserted into a sheet bundle conveyed from the printer section 300, sheets stacked not only on the insert tray 901 but on the manual sheet feed section 125 may be inserted into a sheet bundle conveyed from the printer section 300. In this case, the same processing is carried out.

Referring now to FIGS. 13 to 22, a description will be given of the flows of sheets conveyed from the inserter 900 and the printer section 300 when the finisher houses them on the housing guide 820.

The bookbinding mode is a mode in which the finisher 500 inserts a sheet placed on the insert tray 901 which is for use as a front cover into a sheet bundle discharged from the printer section 300 and binds a book by carrying out the folding process and the binding process on the sheet bundle into which the front cover has been inserted.

FIG. 13 is a view useful in explaining an image forming process carried out by the printer section 300 in the case where the bookbinding mode is set as the operation mode.

The bookbinding mode is set as the operation mode through operation of the operating section 1, and the start key is depressed. In response to the depression of the start key, the image reader section 200 reads a plurality of originals stacked on the tray 1001 of the original feeder 100 sequentially from the first page, and the read original images are sequentially stored in the hard disk 206 within the image signal controller 202. On this occasion, the image reader section 200 counts the number of the originals which have been read. When reading of all the originals is completed, the order in which the plurality of read original images are formed on sheets and the positions on the sheets at which the images are formed are determined using the following expression (1):

$$M=n\times 4-k \quad (1)$$

In the expression (1), M is the number of originals, n is the number of sheets on which read original images are to be formed (n is an integer of 1 or more), and k is any of values 0, 1, 2, and 3.

Assuming that the number of read originals is eight, a description will now be given of the image forming process carried out in the bookbinding mode.

Figure 13A:
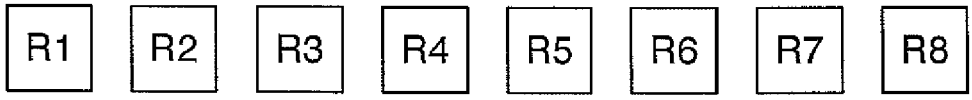
FIG. 13 is a view useful in explaining an image forming process carried out by a printer section appearing in FIG. 1 in the case where a bookbinding mode is set as an operation mode.
Figure 13B:
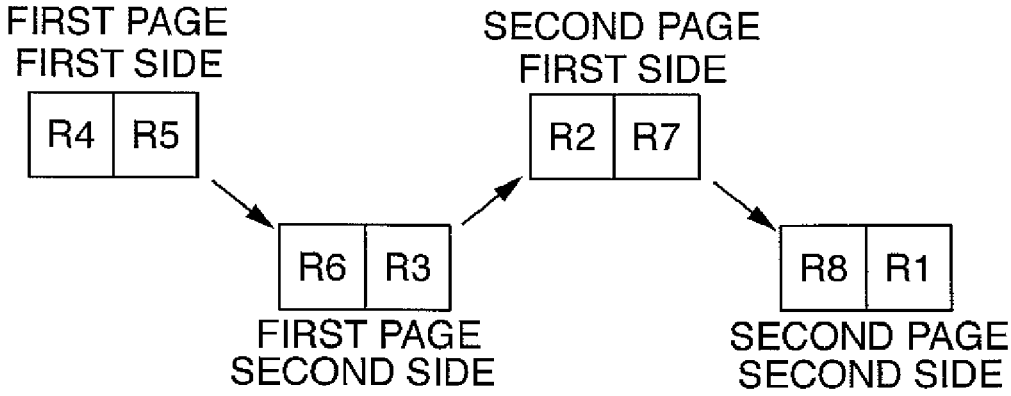

In the hard disk 206, original image data of eight pages (R1, R2, R3, R4, R5, R6, R7, and R8) are stored in an order in which they are read (FIG. 13A). In accordance with the image formation sequence and the positions on the sheets at which the images are formed, which have been determined based on the above expression (1), the printer section 300 forms the image R4 on a left half of a first surface (front side) of a first-page sheet P1 and forms the image R5 on a right half of the first surface (FIG. 13B). The images formed on the sheet are images obtained by carrying out the above described mirroring process.

The printer section 300 conveys the sheet P1 with the images R4 and R5 formed thereon to the transfer section 116 again via the double-sided conveying path 124 to form the image R5 on a left half of a second surface (back side) of the sheet P1 and form the image R3 on a right half of the second surface.

The sheet P1 with the images formed on both sides thereof by the above described process is discharged from the printer section 300 without being inverted, i.e. with the back side thereof facing upward and conveyed to the first bookbinding path 553 of the finisher 500.

Figure 13C:
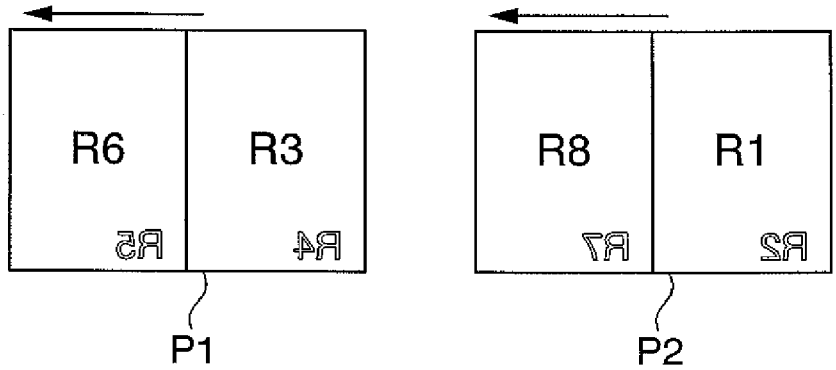

In conveying the sheet P1 to the finisher 500, the printer section 300 conveys the sheet P1 in a direction indicated by an arrow in FIG. 13C in a state in which the second surface on which the images R6 and R3 are formed are facing upward and the image R6 lies at the leading end (FIG. 13C).

In this case, the image R5 is formed on the back side of a part where the image R6 is formed, and the image R4 is formed on the back side of a part where the image R3 is formed.

Subsequently to the above described process, the printer section 300 forms the image R2 on a left half of a first surface (front side) of a second-page sheet P2 and forms the image R7 on a right half of the first surface (FIG. 13B). The images formed on the sheet are images obtained by carrying out the above described mirroring process.

The printer section 300 conveys the sheet P2 with the images R2 and R7 formed thereon to the transfer section 116 again via the double-sided conveying path 124 to form the image R8 on a left half of a second surface (back side) of the sheet P2 and form the image R1 on a right half of the second surface.

The sheet P2 with the images formed on both sides thereof by the above described process is discharged from the printer section 300 without being inverted, i.e. with the second surface thereof facing upward and conveyed to the first bookbinding path 553 of the finisher 500.

In conveying the sheet P2 to the finisher 500, the printer section 300 conveys the sheet P2 in a direction indicated by an arrow in FIG. 13C in a state in which the second surface on which the images R8 and R1 are formed are facing upward and the image R8 lies at the leading end (FIG. 13C).

In this case, the image R7 is formed on the back side of a part where the image R8 is formed, and the image R2 is formed on the back side of a part where the image R1 is formed.

Figure 13D:
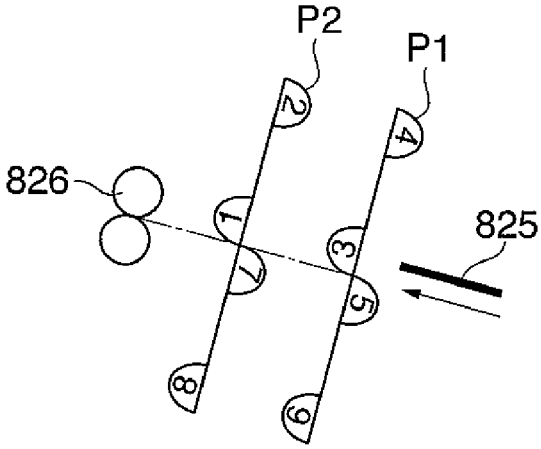

After being subjected to the above described process, the sheets P1 and P2 are sequentially conveyed into and housed in the housing guide 802 via the first bookbinding path 553 of the finisher 500. In the housing guide 820, the sheets P1 and P2 are housed on the projecting member 715 side and the folding roller pair 816 side with their respective first surfaces facing to the projecting member 825 (FIG. 13D). After that, the sheet positioning member 823 positions the sheets P1 and P2 in the housing guide 820.

Figure 14A:
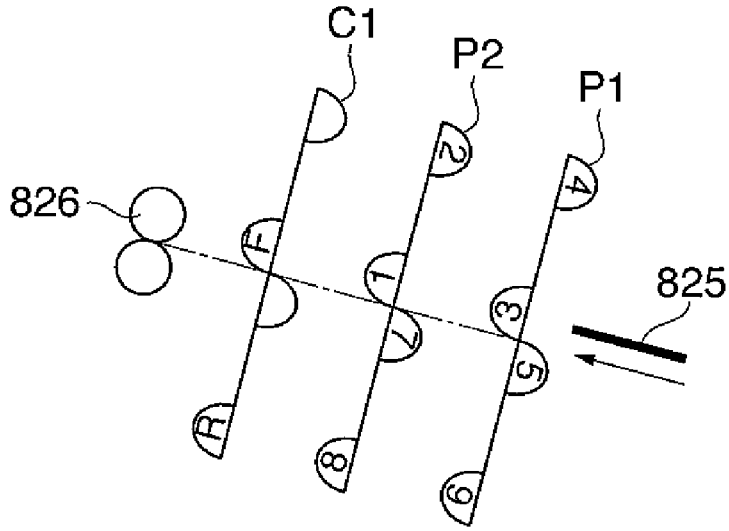
FIG. 14 is a view useful in explaining a bookbinding process carried out by the finisher appearing in FIG. 1 in the case where the bookbinding mode is set as the operation mode.
Figure 14B:
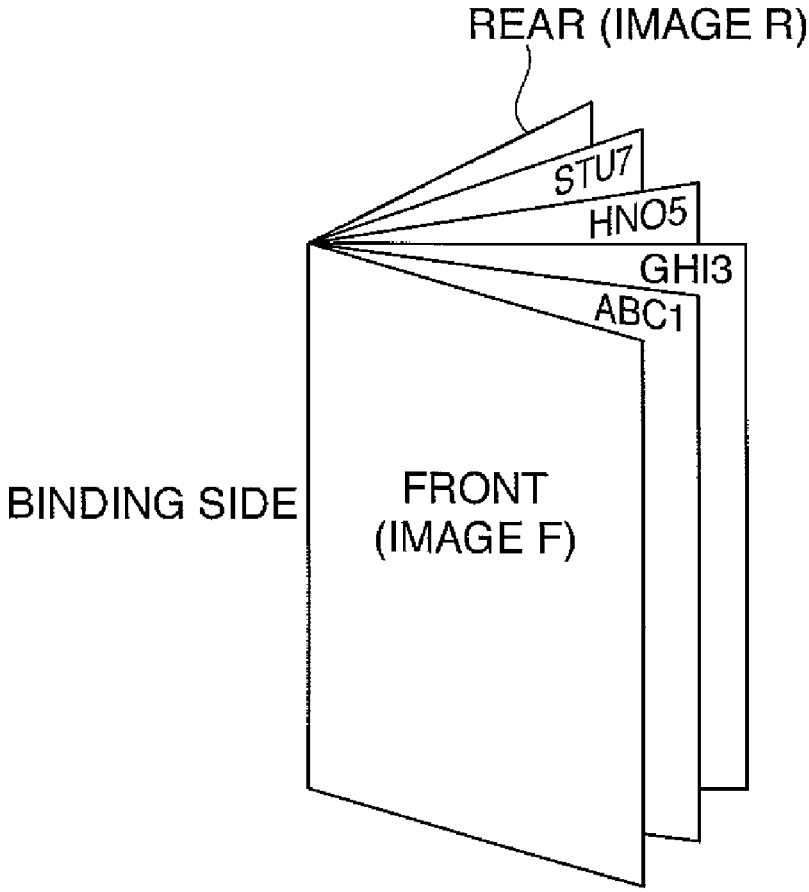

FIGS. 14A and 14B are views useful in explaining a bookbinding process carried out by the finisher 900 appearing in FIG. 1 in the case where the bookbinding mode is set as the operation mode.

Figure 15A:
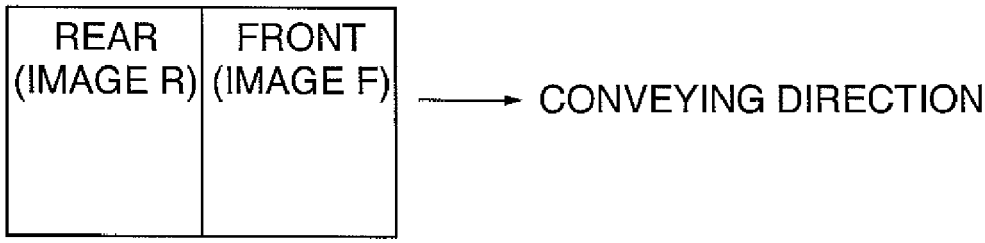
FIG. 15A is a view showing a direction in which a sheet for use as a front cover is conveyed in the bookbinding process carried out by the finisher appearing in FIG. 1.
Figure 15B:
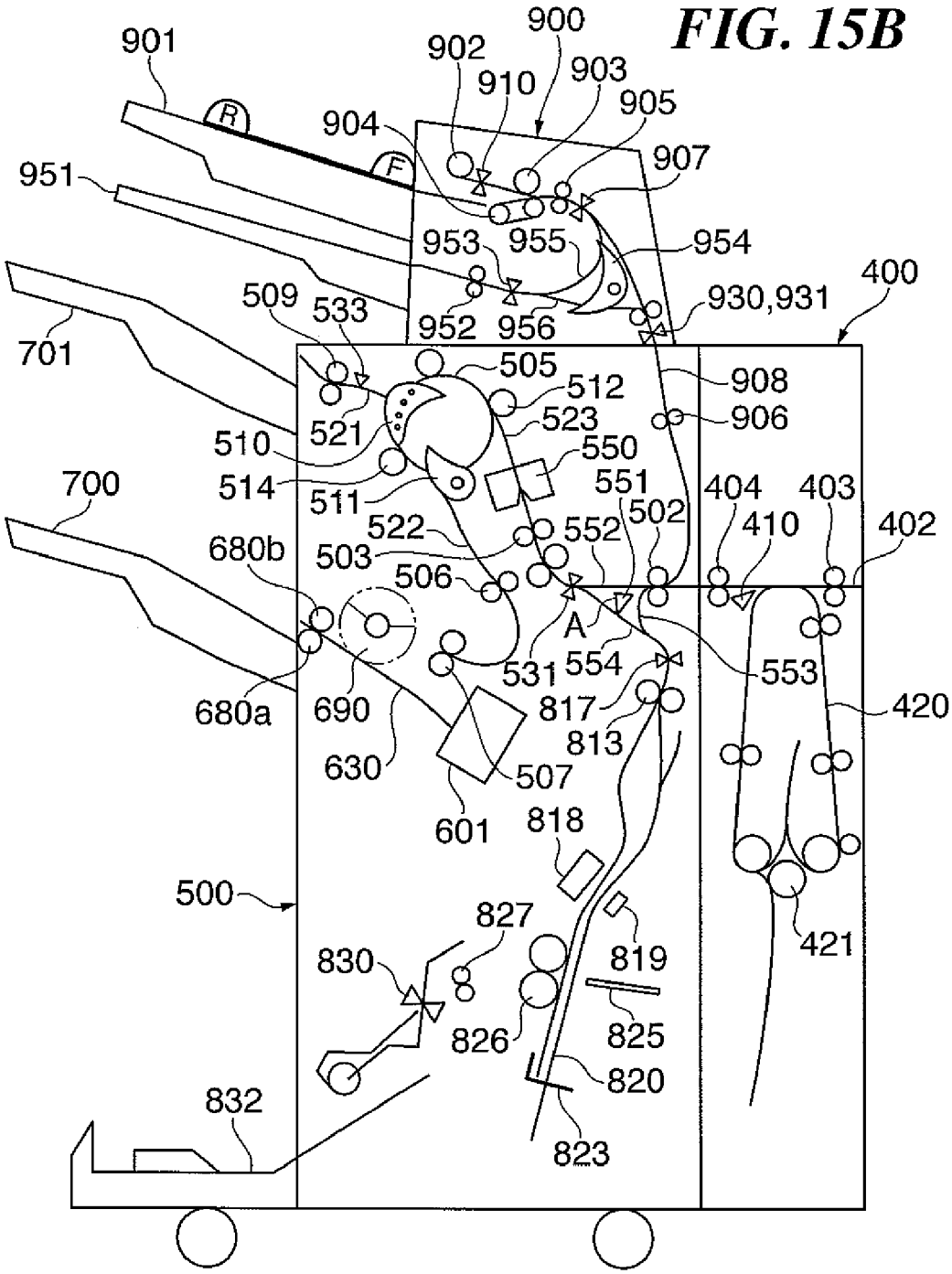
FIG. 15B is a view showing a state in which sheets for use as front covers are stacked on the insert tray in the bookbinding process.

The user stacks a sheet bundle including a sheet C1 on the insert tray 901. On this occasion, the sheet C1 is placed on the insert tray 901 with a surface thereof on which an image R and an image F are formed facing upward, i.e. in an erected image as viewed from the user and in the face-up state (FIGS. 15A and 15B). Since the orientation of the sheet C1 placed on the insert tray 901 is the same as the orientation of originals stacked on the original feeder 100, the ease of operation in placing the sheet C1 on the insert tray 901 can be improved.

Figure 18A:
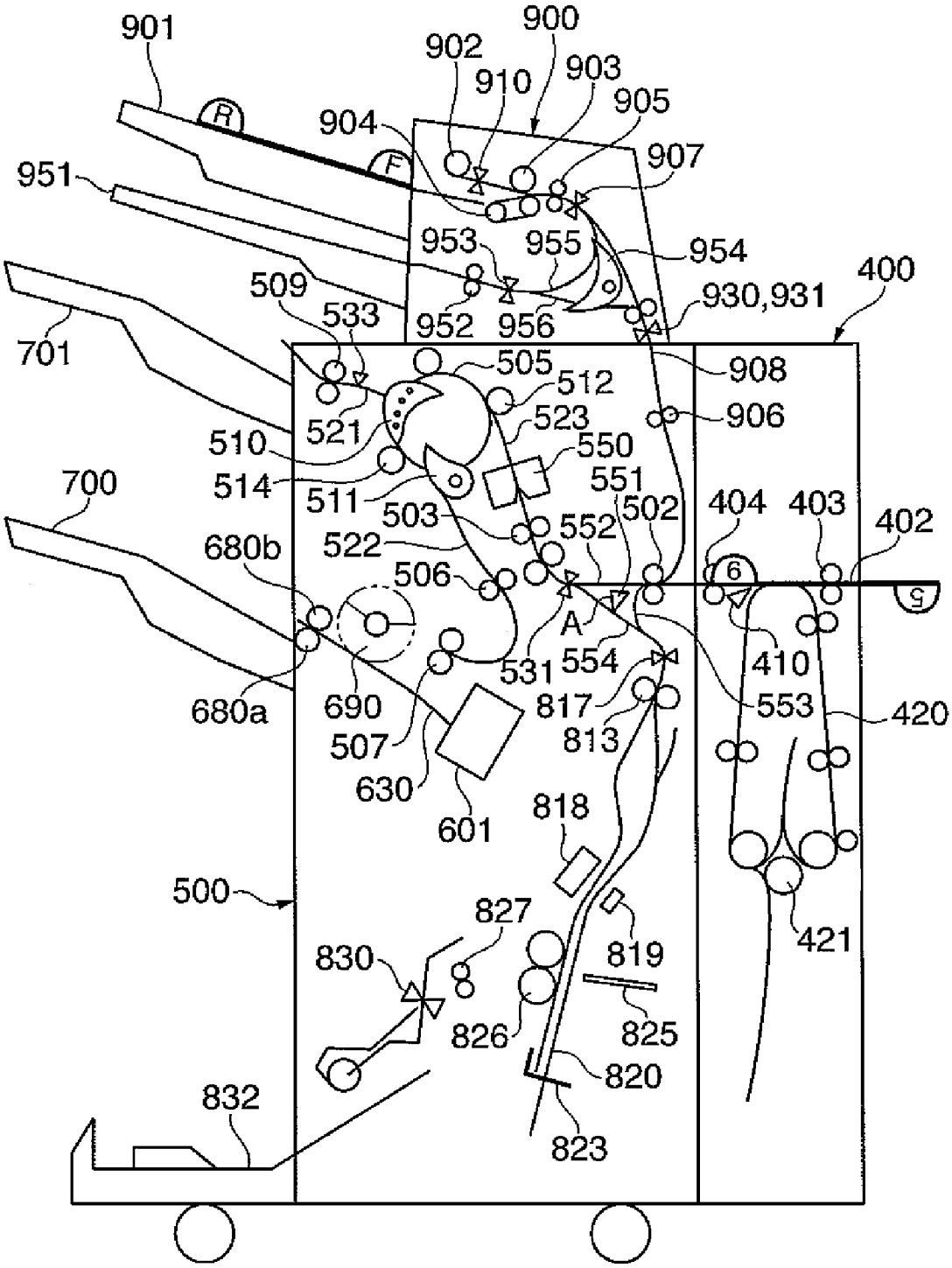
FIG. 18A is a view showing a state in which a sheet P1 has been conveyed in the bookbinding process carried out by the finisher appearing in FIG. 1.
Figure 18B:
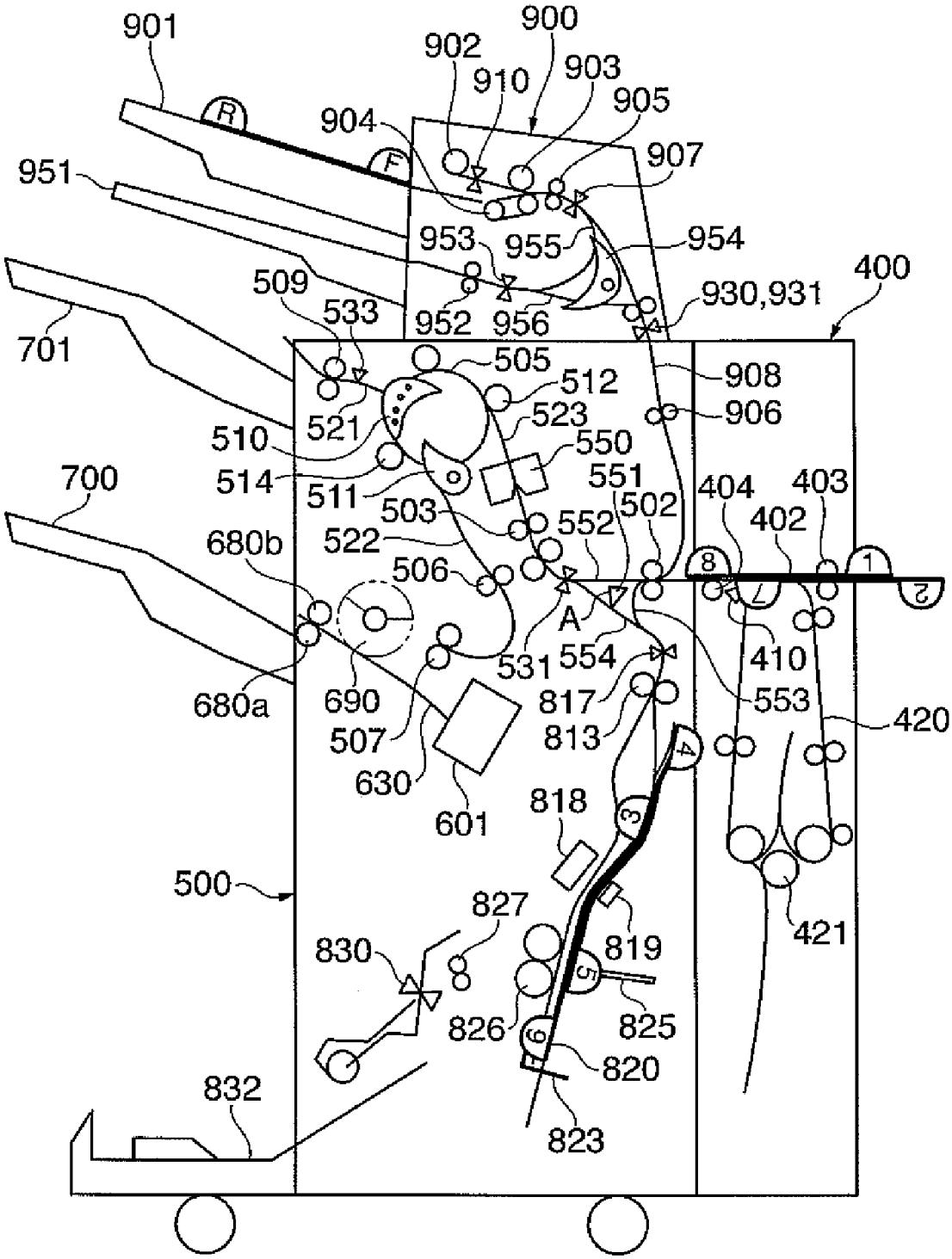
FIG. 18B is a view showing a state in which a sheet P2 has been conveyed in the bookbinding process.

When the start key of the operating section 1 is depressed with the bookbinding mode set as the operation mode, a sheet P1 conveyed from the printer section 300 is conveyed to the finisher 500 (FIG. 18A). The sheet P1 is conveyed to the first bookbinding path 553 by operation of the switching flapper 551 and housed in the housing guide 820, and following the sheet P1, a sheet P2 is conveyed to the first bookbinding path 553 (FIG. 18B).

Figure 16A:
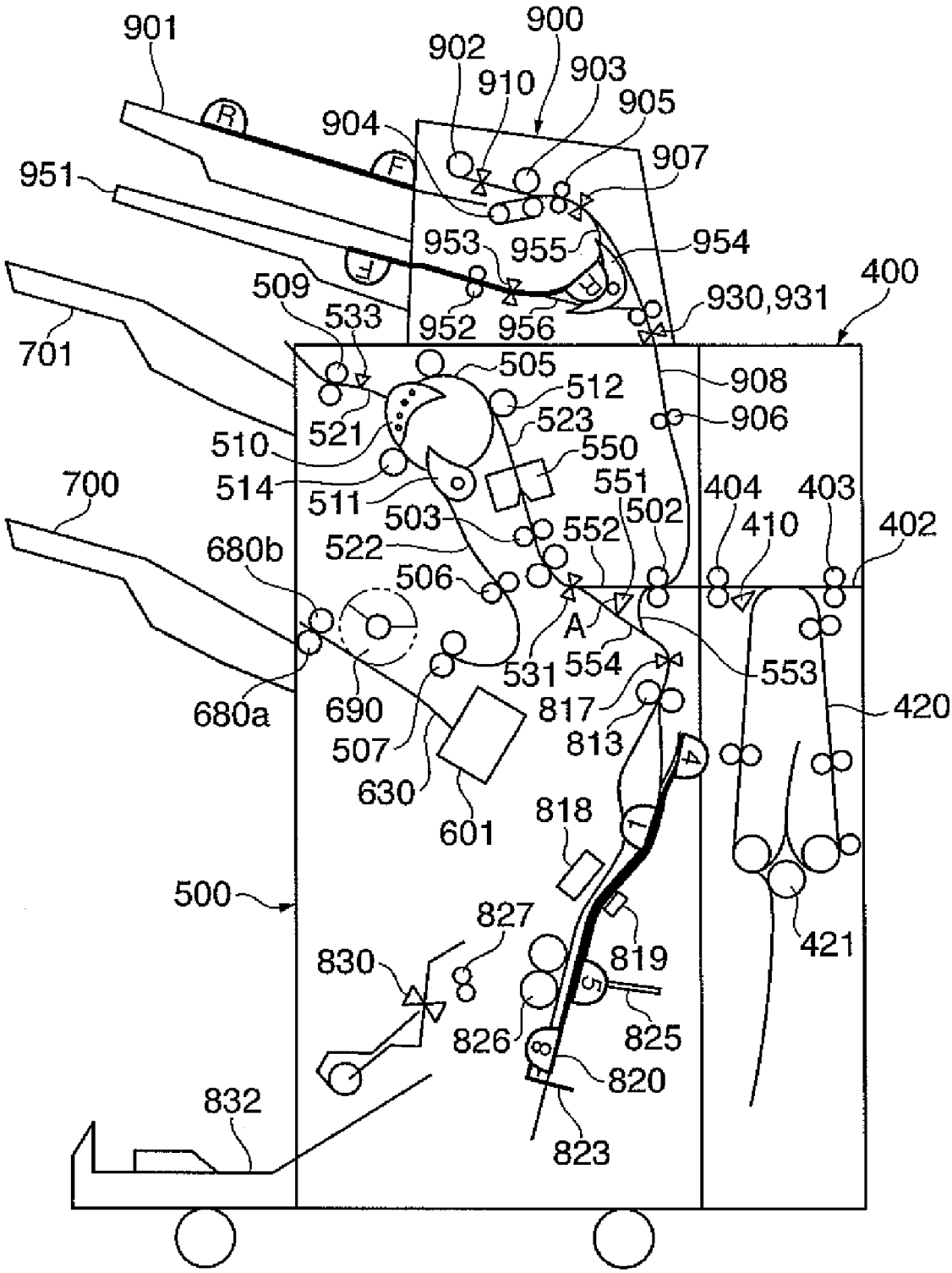
FIG. 16A is a view showing a state in which a sheet for use as a front cover has been conveyed to the inversion path in the bookbinding process carried out by the finisher appearing in FIG. 1.
Figure 16B:
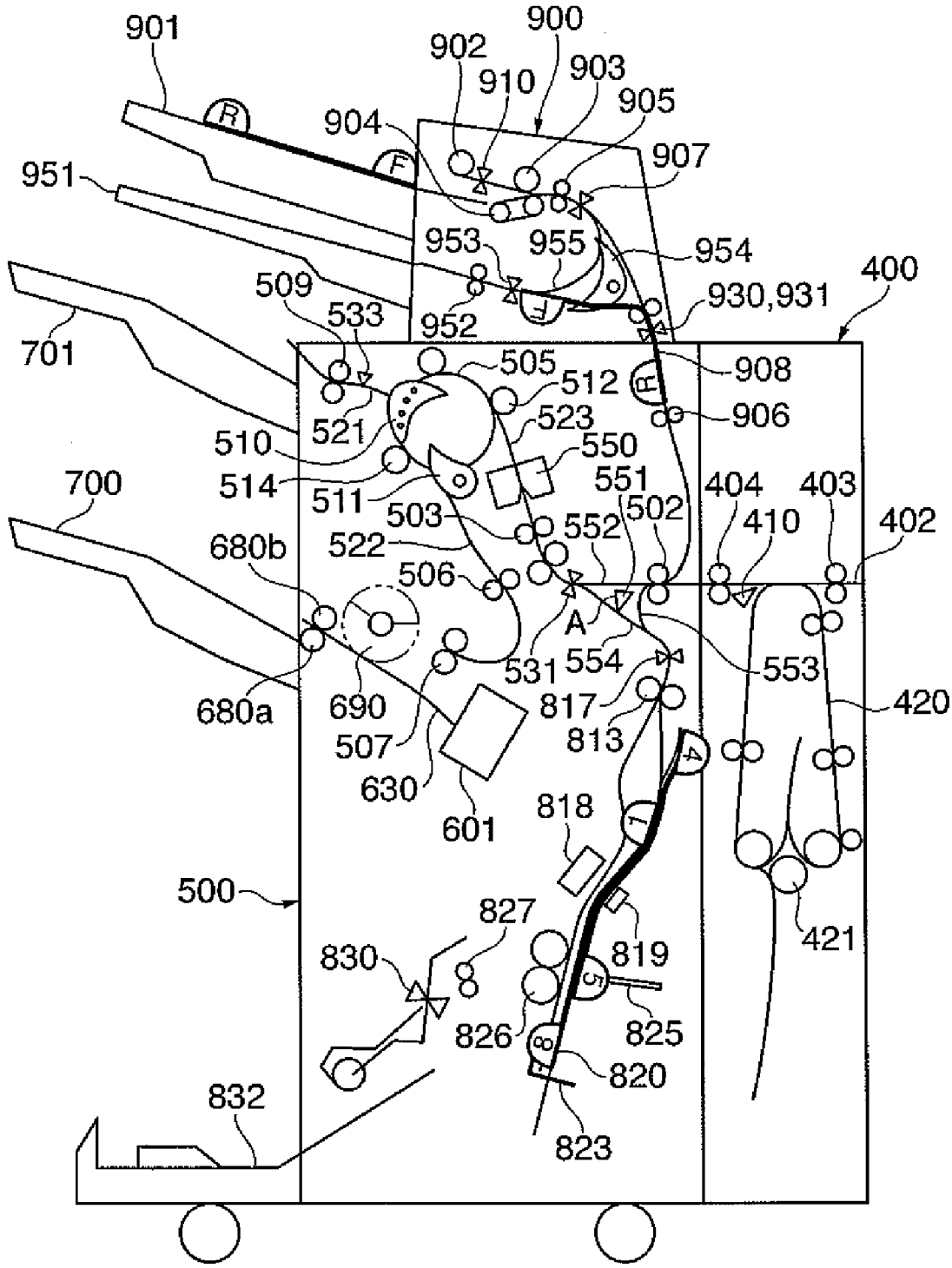
FIG. 16B is a view showing a state in which the sheet for use as the front cover inverted in the bookbinding process has been conveyed into the finisher.
Figure 17A:
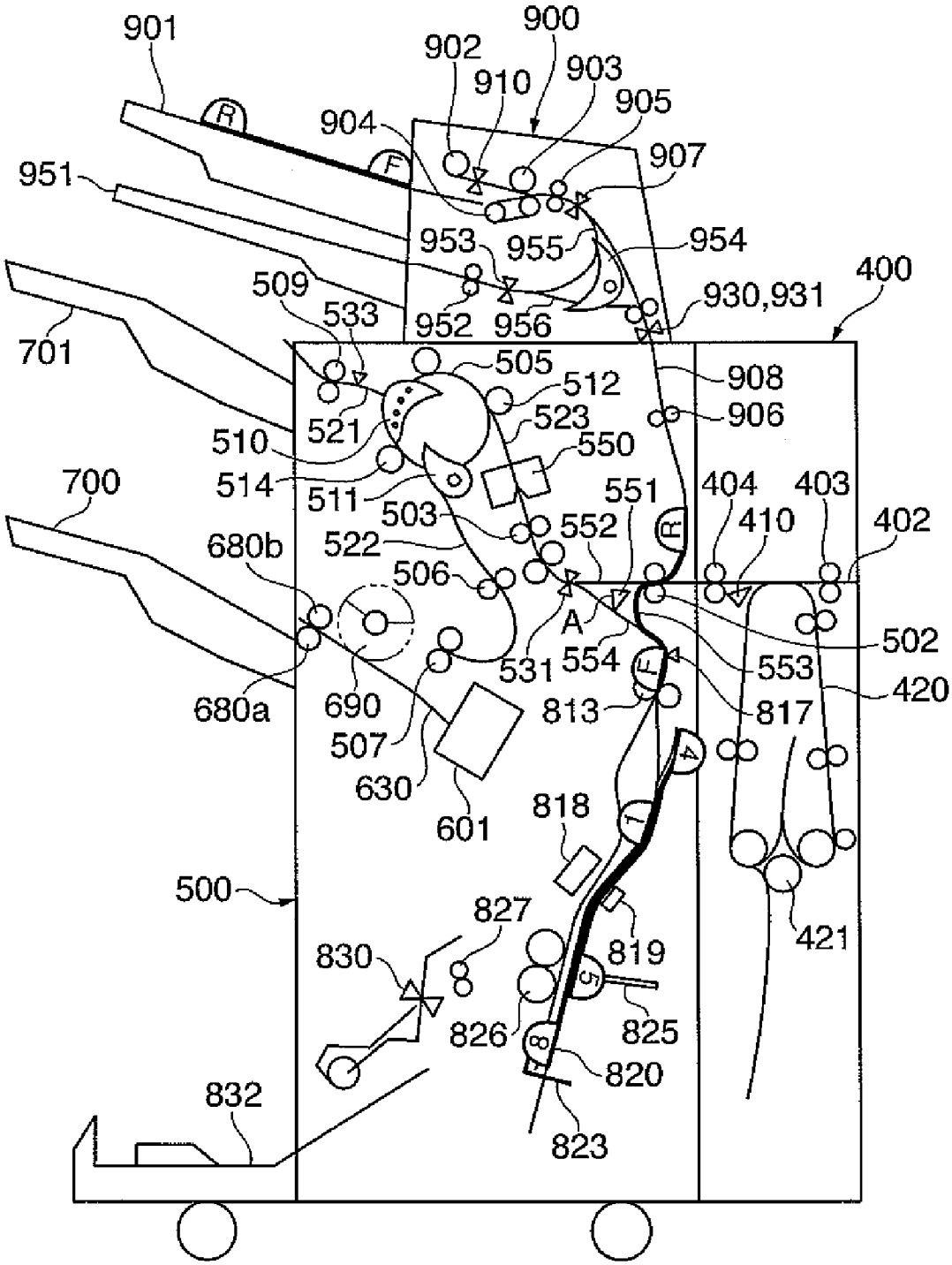
FIG. 17A is a view showing the state of the sheet for use as the front cover guided into a first bookbinding path in the bookbinding process carried out by the finisher appearing in FIG. 1.
Figure 17B:
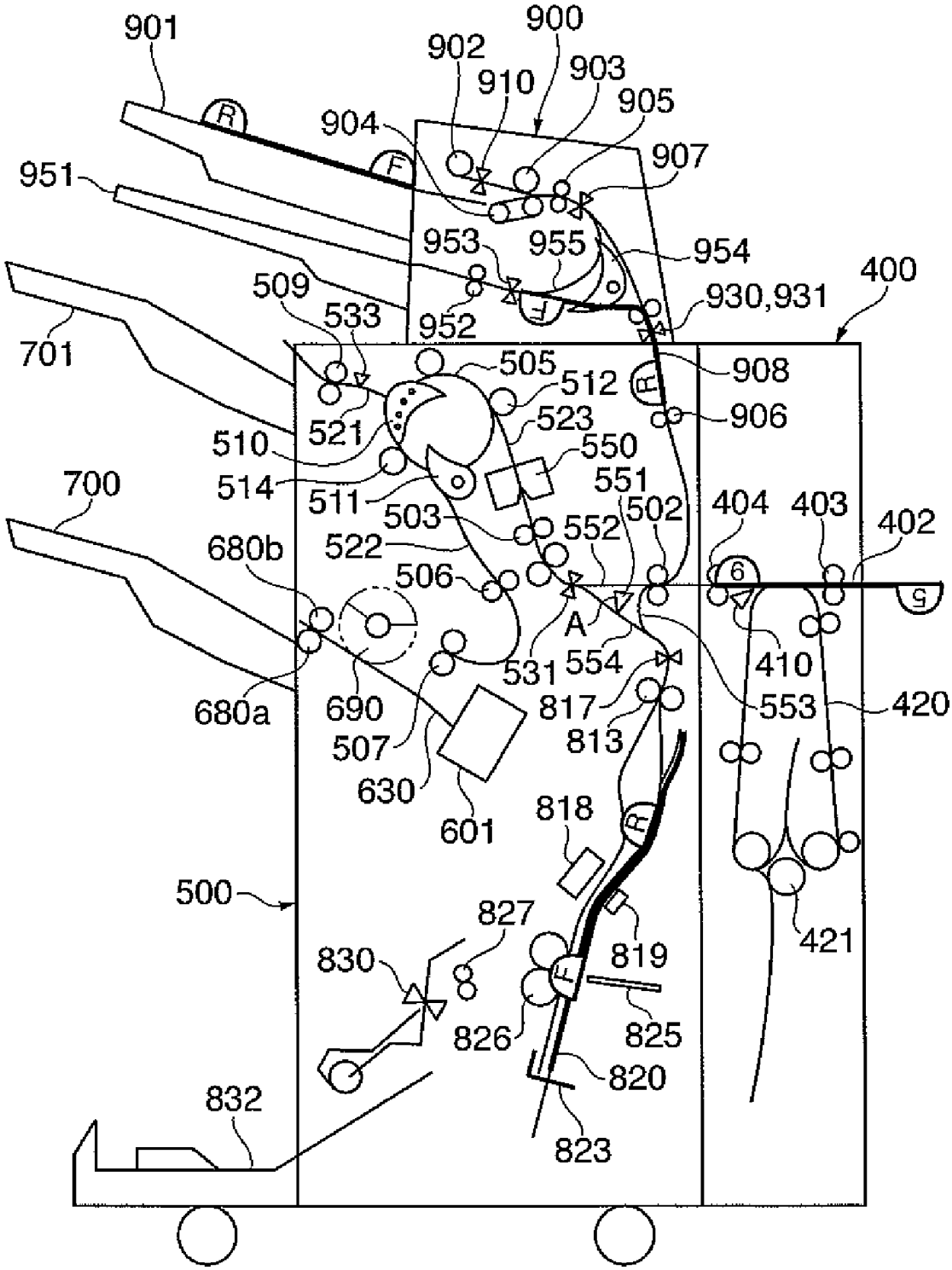
FIG. 17B is a view showing the state of the sheet for use as the front cover conveyed into a housing guide in the bookbinding process.

At this time, the flapper 954 has switched the path to the inversion path 955, and hence the sheet C1 is inverted through the inversion path 955 (FIG. 16A). The sheet C1 is then conveyed to the path 908 (FIG. 16B), conveyed to the first bookbinding path 553 (FIG. 17A), and housed in the housing guide 820. At this time, since the sheet C1 has been inverted once, the sheet C1 is conveyed to the housing guide 820 with the surface on which the image R is formed being at the leading end, and laid over the sheet bundle comprised of the sheets P1 and P2 that have been already housed in the housing guide 820 (FIGS. 13D and 17B).

In outputting a second set, when the sheet C1 is housed in the housing guide 820, a sheet C2 for use as a front cover is separated from the sheet bundle by the separating section of the inserter 900, inverted as is the case with the sheet C1, and conveyed to a position in front of the conveying rollers 906. The conveyance of the sheet C2 is temporarily stopped and retained at a position in front of the conveying rollers 906 until all the sheets P1, P2, C1, P3, P4 are housed in the housing guide 820 (FIG. 17B). The conveyance of the sheet C2 is resumed in synchronization with timing in which all the sheets P1, P2, C1, P3, and P4 are housed in the housing guide 820.

Figure 19:
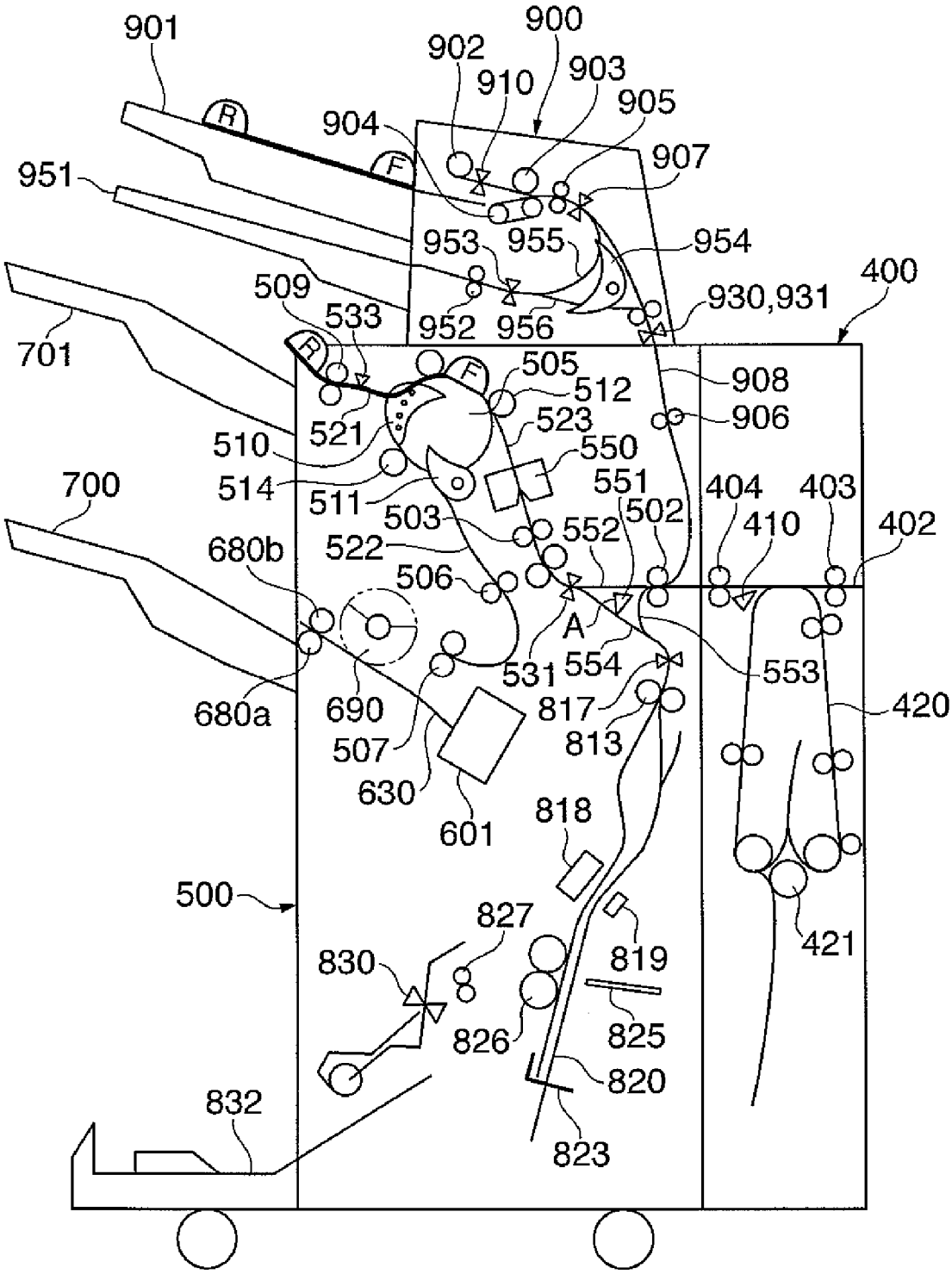
FIG. 19 is a view useful in explaining how an inappropriate sheet is discharged onto a sample tray in the finisher appearing in FIG. 5.

If it is determined in a step S2010 in FIG. 21, described later, that the sheet C2 is an inappropriate sheet, e.g. a sheet having a different size from a predetermined size, the sheet C2 is discharged onto the sample tray 701 via the buffer roller 505 without being stopped (FIG. 19).

After the sheet C1 is housed in the housing guide 820, the finisher 500 causes the projecting member 825 to project toward the sheet bundle comprised of the sheets C1, P1, and P2, so that the sheet bundle is pushed out to a position between the folding rollers 826 (FIG. 14A). As a result, the sheet bundle is folded into two leaves and discharged onto the discharge tray 832.

In the folded sheet bundle, the image F on the sheet C1 is disposed on the front cover page, and the image R on the sheet C1 is disposed on the last page (FIG. 14B). Since the images on the sheets P1 and P2 are arranged according to page order, the images on the sheets C1, P1, and P2 can be identical in orientation.

As described above, the finisher 500 can bind a book in which images are arranged in the same orientation by arranging the images on the sheet C1 conveyed from the inserter 900 on the first page and the last page and arrange the images on the sheets P1 and P2 conveyed from the printer section 300 according to page order.

It should be noted that, with the C1 housed in the housing guide 820, the stapler 818 may staple the sheet bundle at the midsection thereof. In this case, the sheet bundle is bound at the left end thereof as shown in FIG. 14B.

A description will now be given of processes associated with control of conveyance in the finisher 500.

Figure 20:
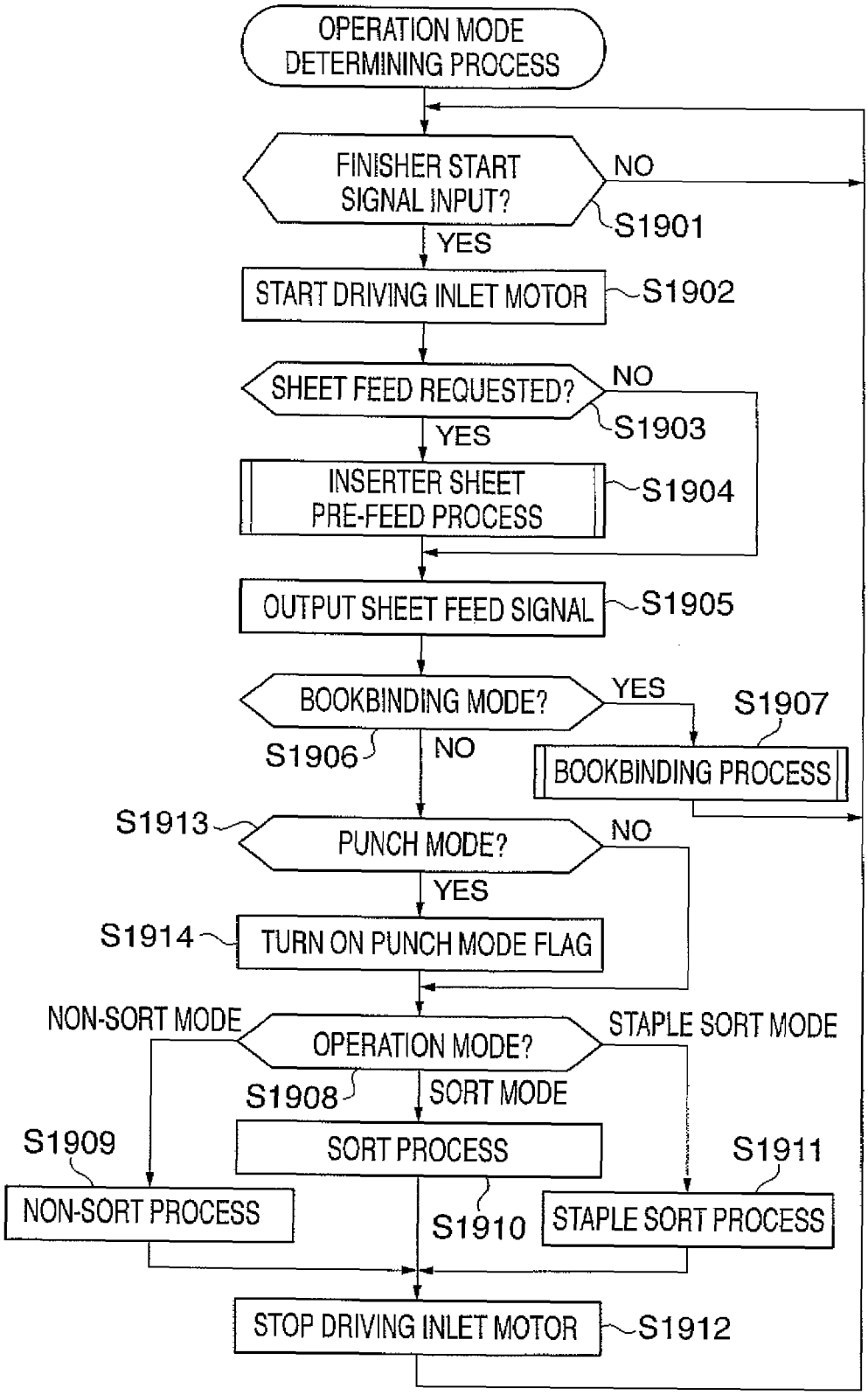
FIG. 20 is a flow chart showing the procedure of an operation mode determining process carried out by a finisher controller appearing in FIG. 6.

FIG. 20 is a flow chart showing the procedure of an operation mode determining process carried out by the finisher controller 501 appearing in FIG. 6.

The process in FIG. 20 is carried out by the CPU circuit section 560 of the finisher controller 501 in accordance with instructions from the CPU circuit section 150.

As shown in FIG. 20, the CPU circuit section 560 determines whether or not a finisher start signal which instructs initiation of the finisher 500 has been input from the CPU circuit section 150 to the finisher controller 501 (step S1901). The finisher start signal is input from the CPU circuit section 150 to the finisher controller 501 when the start key of the operating section 1 is depressed by the user to instruct the copying apparatus 1000 to start copying.

If, as a result of the determination in the step S1901, the finisher start signal has not been input to the finisher controller 501, the above determination is repeatedly carried out until the finisher start signal is input to the finisher controller 501. When the finisher start signal is input to the finisher controller 501, the CPU circuit section 560 starts driving the inlet motor M1 (step S1902). The CPU circuit section 560 determines whether or not there is a sheet feed request for the inserter 900 based on data sent from the communication IC 564 (step S1903). The sheet feed request is input to the finisher controller 501 when the user selects "Inserter" on the front cover designation menu screen (FIG. 7B) displayed on the display panel of the operating section 1.

If, as a result of the determination in the step S1903, there is the sheet feed request for the inserter 900, an inserter sheet pre-feed process in FIG. 21, described later, is carried out (step S1904). If there is no sheet feed request for the inserter 900, the CPU circuit section 560 goes to a step S1905 without carrying out the process in the step S1904.

In the next step S1905, the CPU circuit section 560 causes the CPU circuit section 150 to start an image forming process by outputting a sheet feed signal which gives a sheet feed permission to the CPU circuit section of the copying apparatus 1000 via the communication IC 564 (step S1905). The CPU circuit section 560 determines whether or not the bookbinding mode has been set as the set operation mode based on processing mode data received from the CPU circuit section 150 via the communication IC 564 (step S1906).

If, as a result of the determination in the step S1906, the bookbinding mode has been set as the operation mode, the CPU circuit section 560 carries out a bookbinding process in FIG. 22, described later (step S1907). Upon completing the process in the step S1907, the CPU circuit section 560 returns to the step S1901.

If, as a result of the determination in the step S1906, the bookbinding mode has not been set as the operation mode, the CPU circuit section 560 determines whether or not the operation mode set by the user via the postprocessing selection menu screen (FIG. 7A) is the punch mode (step S1913). If the punch mode has been set as the operation mode, the CPU circuit section 560 turns on a punch mode flag (step S1914) and goes to a step S1908. If the punch mode has not been set as the operation mode, the CPU circuit section 560 goes to the step S1908 without carrying out the process in the step S1914.

In the next step S1908, the CPU circuit section 560 determines whether or not the set operation mode is the non-sort mode, the sort-mode, or the staple sort mode. If the set operation node is the non-sort mode, the CPU circuit section 560 carries out a non-sort process (step S1909) and then goes to a step S1912, described later. If the set operation node is the sort mode, the CPU circuit section 560 carries out a sort process (step S1910) and then goes to the step S1912, described later. If the set operation node is the staple sort mode, the CPU circuit section 560 carries out a staple sort process (step S1911) and then goes the step S1912, described later.

In the next step S1912, the CPU circuit section 560 stops driving the inlet motor M1. The CPU circuit section 560 then returns to the step S1901 to wait for the input of the finisher start signal, but if the punch mode flag was turned on in the step S1914, the CPU circuit section 560 turns off the punch mode flag and returns to the step S1901.

It should be noted that in carrying out processing in any of the steps S1907, S1909, S1910, and S1911, the CPU circuit section 560 carries out the inserter sheet pre-feed process in the step S1904 first if determining in the step S1903 that there is the sheet feed request for the inserter 900.

Figure 21:
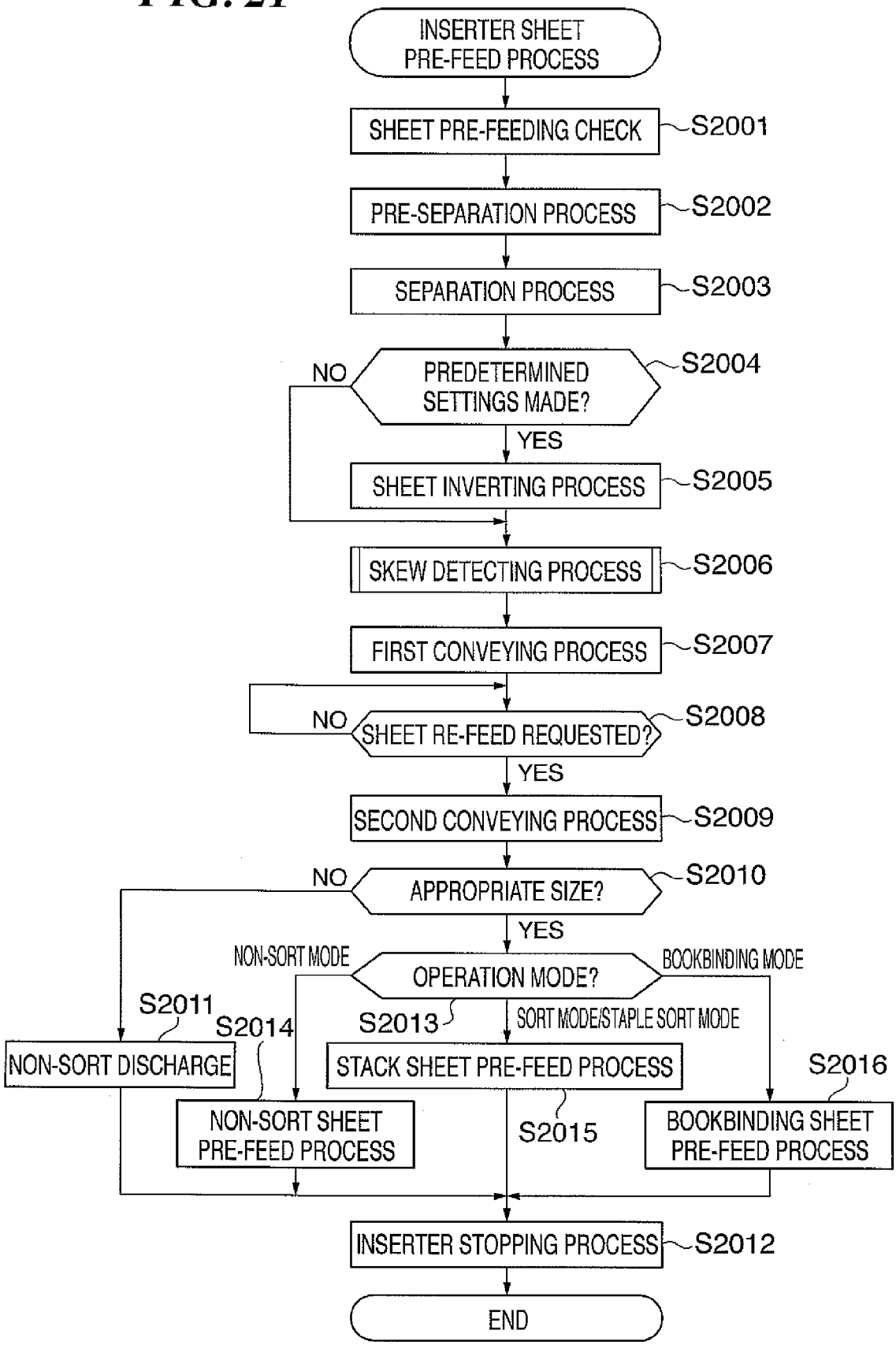
FIG. 21 is a flow chart showing the procedure of an inserter sheet pre-feed process in a step S1904 in FIG. 20.

FIG. 21 is a flow chart showing the procedure of the inserter sheet pre-feed process in the step S1904 in FIG. 20.

The process in FIG. 21 is carried out if, as a result of the determination in the step S1903 in FIG. 20, there is the sheet feed request for the inserter 900. Specifically, the process conveys a sheet from the inserter 900 to the finisher 500 prior to conveyance of a sheet from the printer section 300 to the finisher 500 and is carried out by the CPU circuit section 560 of the finisher controller 501.

In FIG. 21, the CPU circuit section 560 carries out sheet pre-feed checking to determine whether or not sheet feed conditions for feeding a sheet from the inserter 900 has been satisfied (step S2001). Specifically, the CPU circuit section 560 determines whether or not there is a sheet on the insert tray 901 and checks information related to designated size data input via the operating section 1 and sends an image formation inhibition signal to the CPU circuit section 150 of the copying apparatus 1000.

Next, in a step S2002, the CPU circuit section 560 drives the shutter solenoid SL20 to move down the sheet feed roller 902 and open a sheet feed shutter, not shown, of the inserter 900. Further, the CPU circuit section 560 drives the pickup solenoid SL21 to cause the sheet feed roller 902 to land on the sheet on the insert tray 901 and turns on the clutch CL 10 to transmit driving force of the sheet feed motor M20 to the sheet feed roller 902 (pre-separation process).

Next, in a step S2003, the CPU circuit section 560 starts driving the sheet feed motor M20 upon the lapse of a predetermined time period. Further, by rotating the separation roller 903, the separation belt 904, and the pull-out rollers 905 of the inserter 900, the CPU circuit section 560 separates a sheet C1 which is the uppermost sheet of a sheet bundle C and conveys the sheet C1 to the conveying path 908 (separation process).

Next, in a step S2004, the CPU circuit section 560 determines whether or not predetermined settings have been made through the operating section 1. If the predetermined settings have been made, the CPU circuit section 560 carries out a sheet inverting process out (step S2005) and then goes to a step S2006, described later (first sheet feed mode). If the predetermined settings have not been made, the CPU circuit section 560 goes to the step S2006, described later, without carrying out the process in the step S2005 (second sheet feed mode). The predetermined settings include a setting to designate the sheet C1 as a back cover of sheets discharged in an inverted state from the printer 300 and a setting to carry out the bookbinding process.

Next, in the step S2006, the CPU circuit section 560 carries out a skew detecting process in FIG. 24, describe later, and in a step S2007, the CPU circuit section 560 carries out a first conveying process.

In the first conveying process in the step S2007, the CPU circuit section 560 monitors the status of the conveyance of the sheet C1 using the sheet feed sensor 907. When the sheet feed sensor 907 detects the leading end of the sheet C1, the CPU circuit section 560 turns off the clutch CL10 and starts counting clocks output from a clock sensor provided in the sheet feed motor M20. The CPU circuit section 560 drives the sheet feed motor M20 until the counted value becomes equal to a predetermined value N1. The counting is carried out until each of the sheet feed sensor 907 and the set sensor 953 stops detecting the sheet C1. The first conveying process is intended to convey a sheet conveyed from the inserter 900 via the pull-out rollers 905 to a position in front of the conveying rollers 906 and temporarily stops the sheet at this position (FIG. 17B).

Next, in a step S2008, the CPU circuit section 560 determines whether or not a request for re-feeding the sheet C1 has been given to the inserter 900 from the CPU circuit section 150 of the copying apparatus 1000 and repeatedly carries out this determination until a request for re-feeding the sheet C1 is given from the CPU circuit section 150 of the copying apparatus 1000 to the CPU circuit section 560 of the finisher controller 501. In response to the request for re-feeding the sheet C1, a second conveying process is carried out (step S2009).

In the second conveying process in the step S2009, the CPU circuit section 560 resumes driving the sheet feed motor M20 to convey the sheet C1 being at a standstill in front of the conveying rollers 906 toward the inlet rollers 502. After that, when the sheet feed sensor 907 or the set sensor 953 detects the trailing end of the sheet C1, the CPU circuit section 560 terminates the counting operation started in the processing in the step S2003. The CPU circuit section 560 calculates the length of the sheet C1 in the conveying direction thereof based on the value counted by the counting operation.

Next, in a step S2010, the CPU circuit section 560 determines whether or not the sheet C1 has an appropriate size based on the calculated length of the sheet C1 in the conveying direction thereof and the designated size data acquired in the processing in the step S2001. If the sheet C1 has an appropriate size, the CPU circuit section 560 causes the switching flapper 510 to switch the path to the non-sort path 521. Further, the CPU circuit section 560 drives the buffer motor M2 and the sheet discharge motor M3 to discharge the sheet C1 onto the sample tray 701 via the non-sort path 521. Further, the CPU circuit section 560 notifies the CPU circuit section 150 of the copying apparatus 1000 that the sheet C1 with an inappropriate size has been conveyed from the inserter 900 (step S2011), carries out an inserter stopping process (step S2012), and terminates the present process.

In the inserter stopping process in the step S2012, the CPU circuit section 560 cancels the image formation inhibition signal sent from the CPU circuit section 560 to the CPU circuit section 150 in the step S2001 and stops driving the sheet feed motor M20. Also, the CPU circuit section 560 detects whether or not there is a sheet on the insert tray 901 using the sheet set sensor 910 and continues driving the shutter solenoid SL20 while the sheet lies on the insert tray 901.

If, as a result of the determination in the step S2010, the sheet C1 has an appropriate size, the CPU circuit section 560 determines the operation mode set through the operating section 1 (step S2013).

If, as a result of the determination in the step S2013, the operation mode is the non-sort mode, the CPU circuit section 560 carries out a non-sort sheet pre-feed process in which the sheet C1 conveyed from the inserter 900 is discharged onto the sample tray 701 (step S2014). After that, the CPU circuit section 560 carries out the process in the step S2012 and terminates the present process.

If, as a result of the determination in the step S2013, the operation mode is the sort mode or the staple sort mode, the CPU circuit section 560 carries out a pre-stacking sheet feed process in which the switching flappers 510 and 511 are caused to switch the path to the sort path 533 so that the sheet C1 is guided to the processing tray 630 (step S2015). After that, the CPU circuit section 560 carries out the process in the step S2012 and terminates the present process.

In the pre-stacking sheet feed process in the step S2015, when the sheet C1 conveyed from the inserter 900 is set to be used as a front cover, the sheet C1 conveyed from the inserter 900 is placed in the face-down state on the processing tray 630 and aligned on the processing tray 630. When the sheet C1 are set to be used as a back cover, it is placed in the face-up state and aligned on the processing tray 630. Also, it becomes possible for the stapler 601 to bind a book by stapling a sheet bundle comprised of a plurality of sheets stacked on the processing tray 630.

If, as a result of the determination in the step S2013, the operation mode is the bookbinding mode, the CPU circuit section 560 carries out a bookbinding sheet pre-feed process in which the sheet C1 is held on standby in the conveying path 908 (step S2016) (FIG. 17B), carries out the process in the step S2012, and terminates the present process.

According to the process in FIG. 21, if the sheet C1 does not have an appropriate size ("NO" to the step S2010), the CPU circuit section 560 causes the switching flapper 510 to switch the path to the non-sort path 521. Further, the CPU circuit section 560 drives the buffer motor M2 and the sheet discharge motor M3 to discharge the sheet C1 onto the sample tray 701 via the non-sort path 521. Further, the CPU circuit section 560 notifies the CPU circuit section 150 of the copying apparatus 1000 that the sheet C1 with an inappropriate size has been conveyed from the inserter 900 (step S2011) and carries out the inserter stopping process (step S2012). By carrying out these processes, it is possible to recognize the size of a front cover in advance when stacking sheets conveyed from the inserter 900 conveyed from the inserter 900 and sheets conveyed from the printer section 300 in a mixed state. Further, the system-down of the copying system 2000 caused by a mismatch between the size of sheets conveyed from the inserter 900 and sheets conveyed from the printer section 300 can be suppressed to the minimum possible level.

Figure 22:
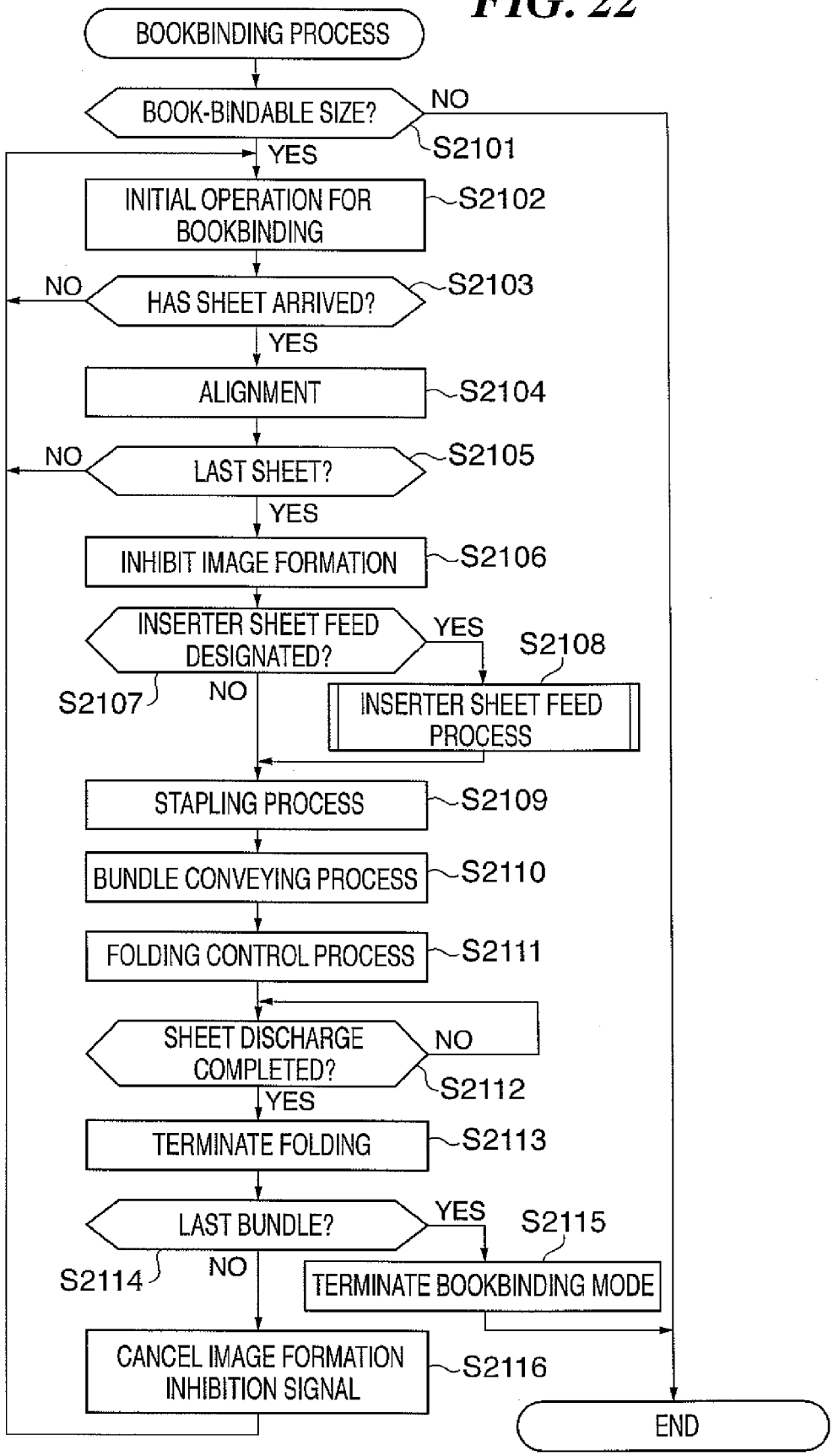
FIG. 22 is a flow chart showing the procedure of a bookbinding process in a step S1907 in FIG. 20.

FIG. 22 is a flow chart showing the procedure of the bookbinding process in the step S1907 in FIG. 20.

The process in FIG. 22 is carried out if, as a result of the determination in the step S1906 in FIG. 20, the operation mode is the bookbinding mode and is carried out by the CPU circuit section 560 of the finisher controller 501.

As shown in FIG. 22, the CPU circuit section 560 determines whether or not the size of a sheet conveyed from the printer section 300 to the finisher 500 is a size that can be book-bound based on size information (step S2101).

If, as a result of the determination in the step S2101, the size of a sheet conveyed from the printer section 300 to the finisher 500 is not a size that can be book-bound, the CPU circuit section 560 immediately terminates the present process, and if the size of a sheet conveyed from the printer section 300 to the finisher 500 is a size that can be book-bound, the CPU circuit section 560 carries out initial operation for bookbinding (step S2102).

In the initial operation for bookbinding in the step S2102, the CPU circuit section 560 drives the conveying motor 813 to rotate the bookbinding rollers 813, thereby making sheet conveyance possible. Further, the CPU circuit section 560 drives the switching solenoid SL10 to cause the switching flapper 551 to switch the path to the first bookbinding path 553, so that a sheet from the printer section 300 is guided to the housing guide 820. The CPU circuit section 560 positions a truing-up member, not shown, such that the width thereof has a predetermined amount of margin relative to the sheet width. Further, the CPU circuit section 560 rotates the positioning motor M11 a predetermined number of steps so that the distance from the sheet positioning member 823 to the stapling position of the stapler 818 can be half the length of a sheet in the conveying direction thereof.

Next, in a step S2103, based on a signal output from the bookbinding inlet sensor 817, the CPU circuit section 560 determines whether or not the sheet conveyed from the printer section 300 has been conveyed into the housing guide 820. If the sheet conveyed from the printer section 300 has not yet been conveyed into the housing guide 820, the CPU circuit section 560 returns to the step S2102. If the sheet conveyed from the printer section 300 has been conveyed into the housing guide 820, the CPU circuit section 560 activates the truing-up member, not shown, upon the lapse of a predetermined time period to align the sheet housed in the housing guide 820 in the direction of the sheet width (step S2104).

Next, in a step S2105, the CPU circuit section 560 determines whether or not the sheet processed in the step S2104 is the last sheet of sheets that should be bound into a book. If the sheet is the last sheet, the CPU circuit section 560 returns to the step S2102. If the sheet is the last sheet, the CPU circuit section 560 outputs an image formation prohibition signal to the CPU circuit section 150 so as to inhibit sheet conveyance from the printer section 300 to the finisher 500 (step S2106) and then goes to a step S2107.

In the next step S2107, the CPU circuit section 560 determines whether or not the user has instructed sheet feed from the inserter 900 via the screen view on the display panel of the operating unit (FIG. 7B). If the user has instructed sheet feed from the inserter 900, the CPU circuit section 560 carries out an inserter sheet feed process in FIG. 23, described later (step S2108) and carries out the stapling process on the sheet bundle aligned in the housing guide 820 (step S2109). If the user has not instructed sheet feed from the inserter 900, the CPU circuit section 560 carries out the stapling process without carrying out the inserter sheet feed process in the step S2108 (step S2109).

Next, in a bundle conveying process in a step S2110, the CPU circuit section 560 drives the positioning motor M1 to move down the sheet positioning motor 823 and drives the conveying motor M10 again to rotate the bookbinding rollers 813. As a consequence, the sheet bundle is conveyed by an amount corresponding to the distance between the stapling position of the stapler 818 and the nip position of the folding rollers 825.

Next, in a step S2111, the CPU circuit section 560 drives the clutch CL1 and the folding motor M12 to move the projecting member 825 toward the folding rollers 826 (as indicated by the arrow in FIG. 14A). As a consequence, the center of the sheet bundle which is the stapled position on the sheets is guided to the nip point of the folding rollers 826, and the sheet bundle is folded into two leaves by the projecting member 825 and the folding rollers 826 (folding control process). It should be noted that the projecting member 825 is configured to be caused to reciprocate by a cam mechanism. The CPU circuit section 560 stops driving the clutch CL1 when a sensor, not shown, detects that the projecting member 825 has made one reciprocating motion. Next, in a step S2112, the CPU circuit section 560 determines whether or not the sheet bundle has been discharged onto the discharge tray 832 using the book-bound discharged sheet sensor 830 which detects the trailing end of a sheet folded into two leaves. The CPU circuit section 560 repeatedly carries out the above determination until the sheet bundle is discharged to the discharge tray 832. When the sheet bundle is discharged onto the discharge tray 832, the CPU circuit section 560 stops driving the folding motor M12 (step S2113). Further, the CPU circuit section 560 determines whether or not the sheet bundle is the last sheet bundle to be book-bound (step S2114). If the sheet bundle is the last sheet bundle to be book-bound, the CPU circuit section 560 terminates the bookbinding mode by moving the truing-up member and the sheet positioning member 823 to their respective predetermined waiting positions and switching the switching flapper 551 to enable passage through the finisher path 522 (step S2115) and then terminates the present process.

If, as a result of the determination in the step S2114, the sheet bundle is the sheet bundle to be book-bound, the CPU circuit section 560 cancels the image formation inhibition signal, notifies the CPU circuit section 150 of the cancellation (step S2116), and then returns to the step S2102.

Figure 23:
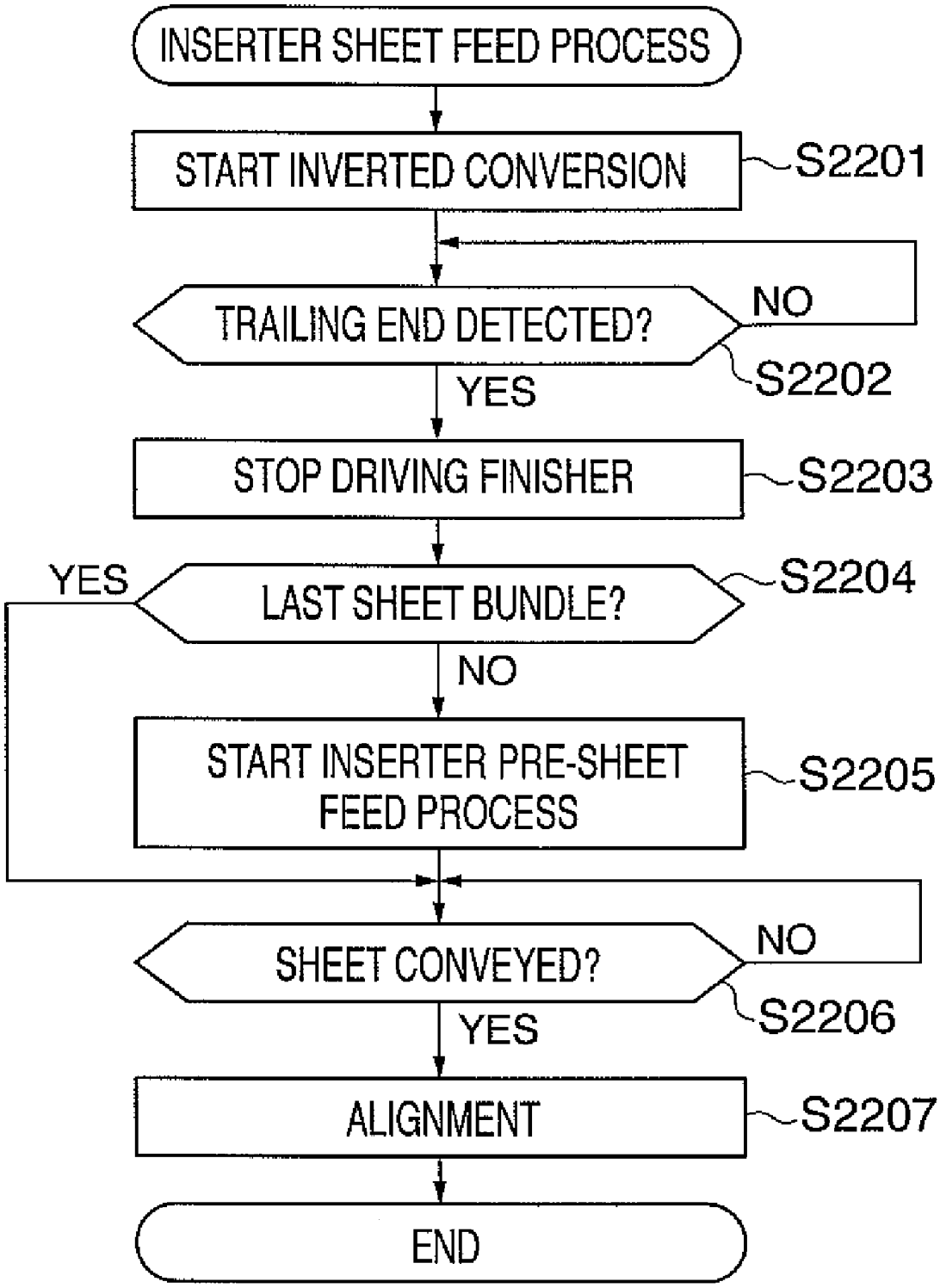
FIG. 23 is a flow chart showing the procedure of an inserter sheet feed process in a step S2108 in FIG. 22.

FIG. 23 is a flow chart showing the procedure of the inserter sheet feed process in the step S2108 in FIG. 22.

The process in FIG. 23 is carried out if, as a result of the determination in the step S2107 in FIG. 22, sheet feed from the inserter 900 has been instructed. In the process in FIG. 23, a sheet is conveyed from the inserter 900 to the housing guide 820.

In the present embodiment, the inserter sheet pre-feed process in FIG. 21 is carried out prior to the inserter sheet feed process. As a result of the pre-bookbinding sheet feed process in the step S2016 of the inserter sheet pre-feed process in FIG. 21, a sheet C1 from the inserter 900 waits on the conveying path 908 (FIG. 16B).

As shown in FIG. 23, the CPU circuit section 560 sets the rotational directions of the feed motor M20 and the inlet motor M1 to forward directions and drives them. Further, the CPU circuit section 560 drives the conveying motor M10 to start conveying the sheet C1 waiting at the conveying path 908 to the first bookbinding path 553 (FIG. 17A) (step S2201). The CPU circuit section 560 then determines whether or not the trailing end of the sheet C1 has been detected by the bookbinding inlet sensor 817 (step S2202). The CPU circuit section 560 repeatedly carries out the above determination until the trailing end of the sheet C1 is detected by the bookbinding inlet sensor 817. When the trailing end of the sheet C1 is detected by the bookbinding inlet sensor 817, the CPU circuit section 560 stops driving the inlet motor M1 and the feed motor M20 (finisher driving stopping process) (step S2203). That is, in the step S2202, the CPU circuit section 560 continues to convey the sheet C1 until the trailing end of the sheet C1 from the inserter 900 is detected.

Next, in a step S2204, the CPU circuit section 560 determines whether or not the sheet bundle being currently processed is the last sheet bundle to be book-bound. If the sheet bundle being currently processed is the last sheet bundle to be book-bound, the CPU circuit section 560 goes to a step S2206. If the sheet bundle being currently processed is not the last sheet bundle to be book-bound, the CPU circuit section 560 issues a start command for starting the inserter sheet pre-feed process in FIG. 21 to start the inserter sheet pre-feed process and carries out the inserter sheet pre-feed process in tandem with the bookbinding process in FIG. 22 (step S2205).

Next, in the step S2206, the CPU circuit section 560 determines whether or not the sheet C1 conveyed from the inserter 900 has been conveyed into the housing guide 820 using the bookbinding inlet sensor 817 which detects the trailing end of each sheet. The CPU circuit section 560 repeatedly carries out the above determination until the sheet C1 conveyed from the inserter 900 is conveyed into the housing guide 820. When the sheet C1 conveyed from the inserter 900 is conveyed into the housing guide 820, the CPU circuit section 560 activates the truing-up member upon the lapse of a predetermined time period and aligns the sheet C1 housed in the housing guide 820 in the direction of the sheet width (step S2207) and terminates the present process.

Figure 24:
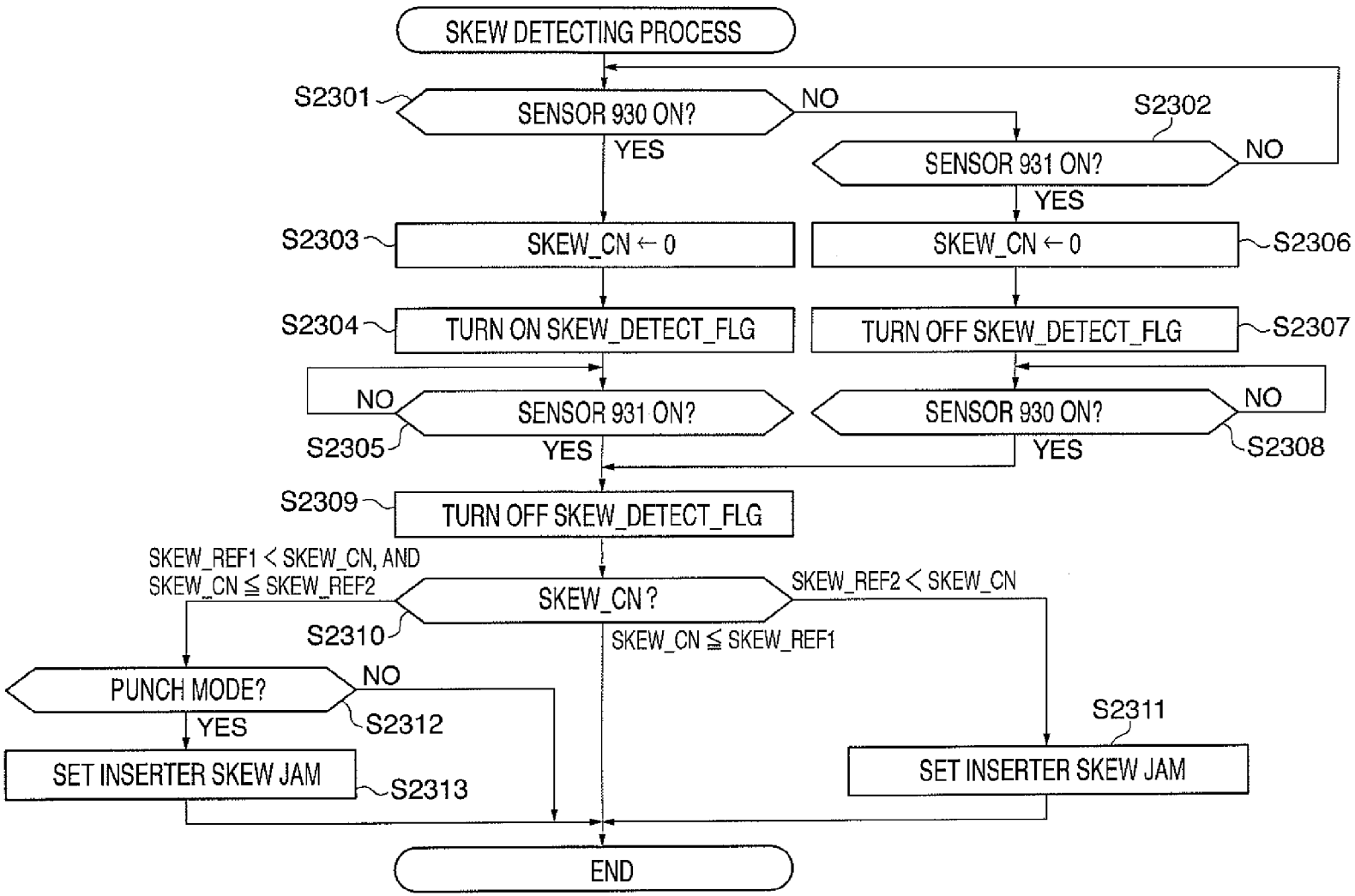
FIG. 24 is a flow chart showing the procedure of a skew detecting process in a step S2006 in FIG. 21.

FIG. 24 is a flow chart showing the procedure of the skew detecting process in the step S2006 in FIG. 21.

The process in FIG. 24 is carried out by the CPU circuit section 560 of the finisher controller 501.

As shown in FIG. 24, the CPU circuit section 560 determines whether or not the skew sensor 930 is on (step S2301). If the skew sensor 930 is on, the CPU circuit section 560 determines whether or not the skew sensor 931 is on (step S2302). If the skew sensor 931 is not on, the CPU circuit section 560 returns to the step S2301.

That is, the CPU circuit section 560 repeatedly carries out the processes in the steps S2301 and S2302 until one of the skew sensor 930 and the skew sensor 931 is turned on, i.e. until the leading end of a sheet reaches one of the skew sensor 930 and the skew sensor 931.

As described above, the skew sensors 930 and 931 are located at respective different positions on a line orthogonal to the sheet conveying direction. Thus, when a sheet conveyed from the insert tray 901 skews, the leading end of the conveyed sheet is detected first by one of the skew sensors 930 and 931.

If, as a result of the determination in the step S2301, the skew sensor 930 is on, the CPU circuit section 560 assigns 0 to a variable SKEW_CN corresponding to a counter for the detection of skew (step S2303). Further, the CPU circuit section 560 turns on a skew detection flag "skew_detect_flg" (step S2304) and determines whether or not the skew sensor 931 is on (step S2305). The CPU circuit section 560 repeatedly carries out the above determination until the skew sensor 931 is on, and when the skew sensor 931 is on, the CPU circuit section 560 goes to a step S2309, described later.

If, as a result of the determination in the step S2302, the skew sensor 931 is on, the CPU circuit section 560 assigns 0 to the variable SKEW_CN corresponding to the counter for the detection of skew (step S2306). Further, the CPU circuit section 560 turns on the skew detection flag "skew_detect_flg" (step S2307) and determines whether or hot the skew sensor 930 is on (step S2308). The CPU circuit section 560 repeatedly carries out the above determination until the skew sensor 930 is on, and when the skew sensor 930 is on, the CPU circuit section 560 returns to the step S2309, described later.

Next, in the step S2309, the CPU circuit section 560 turns off the flag "skew_detect_flg." The CPU circuit section 560 then checks the count value SKEW_CN counted from the turning-on of the flag "skew_detect_flg" to the turning-off of the flag "skew_detect_flg" and calculates the skew amount of the sheet relative to the sheet feed direction based on the value of the variable SKEW_CN.

Next, in a step S2310, the CPU circuit section 560 determines whether or not the value of the variable SKEW_CN is not greater than SKEW_REF1 which is a skew reference value 1 (i.e. SKEW_CN≦SKEW_REF1). If the value of the variable SKEW_CN is not greater than SKEW_REF1 which is the skew reference value 1 (i.e. SKEW_CN≦SKEW_REF1), the CPU circuit section 560 immediately terminates the present process.

If, as a result of the determination in the step S2310, the value of the variable SKEW_CN is greater than SKEW_REF2 which is a skew reference value 2 (i.e. SKEW_CN<SKEW_REF2), the CPU circuit section 560 sets an inserter skew jam, i.e. stops all the loads. It should be noted that the skew reference value 2 is a lower limit of skew amount at which jamming may occur during conveyance of a sheet. The CPU circuit section 560 then inhibits sheet conveyance in the finisher 500, punching on sheets by the punch unit 550, stapling by the stapler 601, and so forth. Further, the CPU circuit section 560 transmits an emergency stop signal which prompts the CPU circuit section 150 of the copying apparatus 1000 to carry out an emergency stop process to the CPU circuit section 150 so as to urgently stop conveying sheets in the printer section 300 (step S2311) and terminates the present process.

Upon receiving the emergency stop signal, the CPU circuit section 150 displays a message indicating the receipt of the emergency stop signal on the display panel of the operating section 1 so as to inform the user to that effect. Further, the CPU circuit section 150 urgently stops the conveyance of a sheet with an image formed thereon so as to inhibit the sheet from being conveyed into the finisher 500.

The CPU circuit section 560 inhibits all of the above described operations in the finisher 500 until the user completely removes the sheet. When the removal of the sheet is completed, the CPU circuit section 560 cancels the inhibition of the operations in the finisher 500 and informs the CPU circuit section 150 of the copying apparatus 1000 that the emergency stop has been canceled.

When informed that the emergency stop has been canceled, the CPU circuit section 150 displays a message indicating the cancellation of the emergency stop signal on the display panel of the operating section 1 so as to inform the user to that effect.

If, as a result of the determination in the step S2310, the value of the variable SKEW_CN is greater than SKEW_REF1 and not greater than SKEW_REF2, the CPU circuit section 560 determines whether or not the set operation mode is the punch mode (step S2312). If the set operation mode is any mode other than the punch mode, the CPU circuit section 560 immediately terminates the present process without stopping all the loads, and if the set operation mode is the punch mode, the CPU circuit section 560 sets an inserter skew jam as in the step S2311 and terminates the present process.

If the operation mode set by the user is any mode other than the punch mode, e.g. the staple mode, the CPU circuit section 560 carries out the stapling process after aligning the sheets conveyed to the processing tray 630. If the operation mode set by the user is the bookbinding mode, the CPU circuit section 560 carries out the bookbinding process after aligning the sheets conveyed to the housing guide 820. Thus, the value of the detected skew amount SKEW_CN does not influence the final sheet alignment quality in binding. On the other hand, if the operation mode set by the user is the punch mode, the CPU circuit section 560 carries out the punching process without aligning the sheets conveyed in the finisher 500. Thus, the sheets are not punched at correct positions, and therefore, the sheet alignment quality is degraded.

For this reason, the CPU circuit section 560 determines in the step S2312 whether or not the operation mode set by the user is the punch mode, and whether or not the CPU circuit section 560 stops all the loads is controlled according to the determination result.

According to the process in FIG. 24, the CPU circuit section 560 sets an inserter skew jam, i.e. stops all the loads when the value of the variable SKEW_CN is greater than SKEW_REF2 (step S2311). Also, the CPU circuit section 560 immediately terminates the present process without stopping all the loads when the value of the variable SKEW_CN is greater than SKEW_REF1 and not greater than SKEW_REF2 and the set operation mode is any mode other than the punch mode ("NO" to the step S2312). Also, if the set operation mode is the punch mode ("YES" to the step S2312), the CPU circuit section 560 sets an inserter skew jam (step S2313). For example, suppose that SKEW_REF1 is 3 mm, and SKEW_REF2 is 9 mm. In this case, if the skew amount of an insert sheet detected by the skew sensors 930 and 931 is greater than 9 mm, there is a possibility that sheet jamming occurs. Thus, the CPU circuit section 560 urgently stops the conveyance of the sheet and inhibits feeding, conveyance, punching, etc. of the sheet. If the detected skew amount of an insert is not greater than 3 mm, the CPU circuit section 560 does not urgently stop the conveyance of the sheet and permits feeding, conveyance, punching, etc. of the sheet. If the detected skew amount of an insert is greater than 3 mm and not greater than 9 mm and the punch mode has been set in advance by the user, the CPU circuit section 560 urgently stops the conveyance of the sheet and inhibits feeding, conveyance, punching, etc. of the sheet.

In this way, the CPU circuit section 560 can send an emergency stop signal to the CPU circuit section 150 of the copying apparatus 1000 before sheet jamming actually occurs, and therefore it is possible to prevent the sheet quality from being degraded.

Also, in the case where the CPU circuit section 560 stops all the loads by setting an inserter skew jam, the user removes a sheet from the finisher 500 and then places the sheet on the insert tray 901 of the inserter 500 again. Thereafter, by giving an instruction for resuming processing via the operating section 1, the user can reuse the sheet. Thus, it is possible to prevent damages to sheets, contamination of sheets, etc. caused by sheet jamming. Thus, the user does not have to prepare the same sheets again, and the user's trouble and effort can be saved.

Further, the CPU circuit section 560 immediately terminates the present process without stopping all the loads and continues conveying sheets when the value of the variable SKEW_CN is greater than SKEW_REF1 and not greater than SKEW_REF2 and the set operation mode is any mode other than the punch mode. Thus, it is possible to prevent unnecessary stop of all the loads and improve user's productivity.

Figure 25:
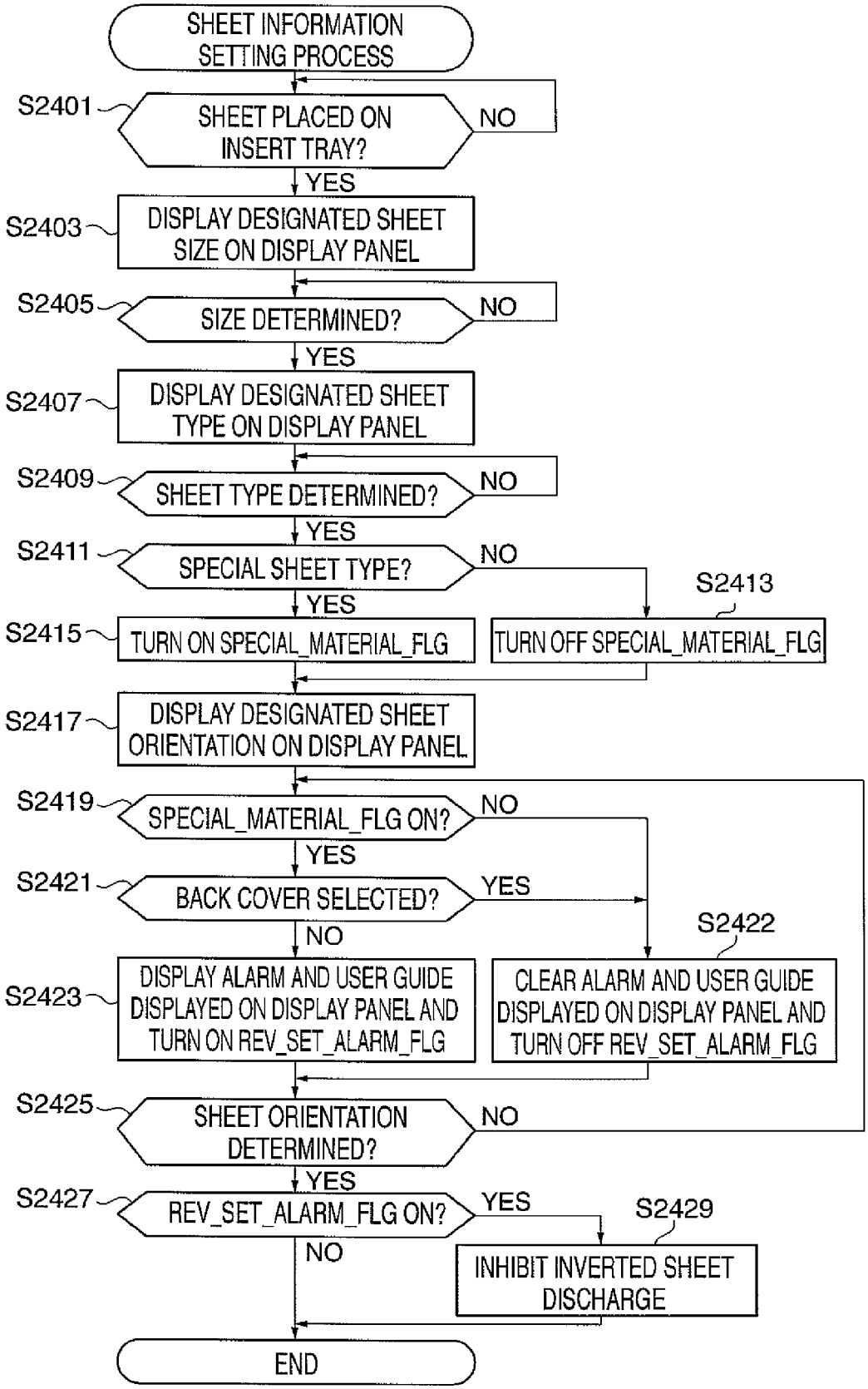
FIG. 25 is a flow chart showing the procedure of a sheet information setting process for sheets stacked on the insert tray appearing in FIG. 5.

FIG. 25 is a flow chart showing the procedure of a sheet information setting process for sheets stacked on the insert tray appearing in FIG. 5.

Figure 26:
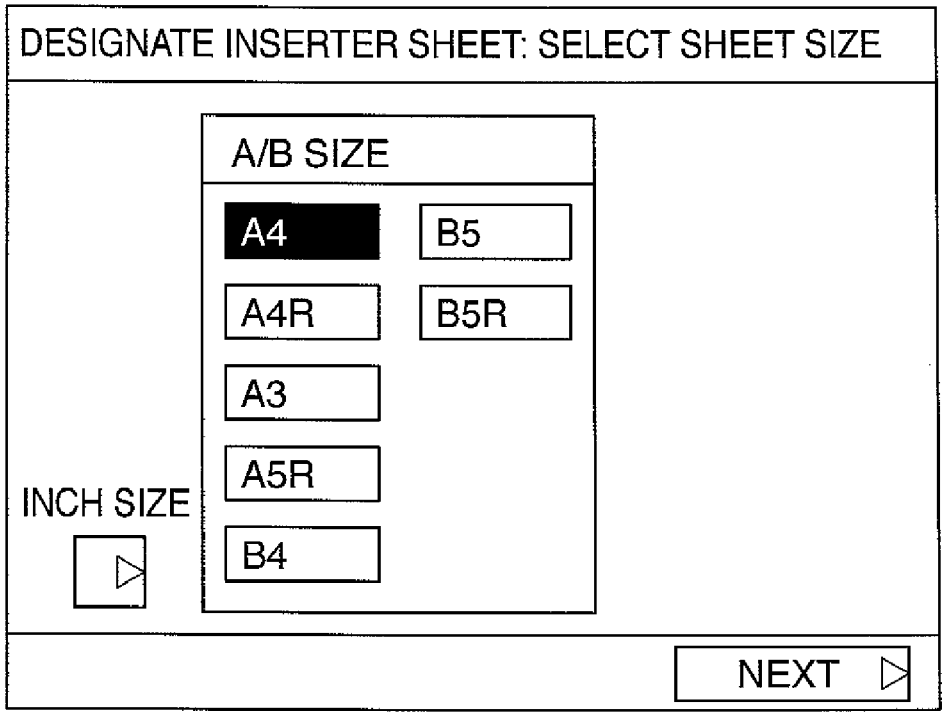
FIG. 26 is a view useful in explaining a "sheet size selection screen" displayed on the display panel in a step S2403 in FIG. 25.
Figure 27:
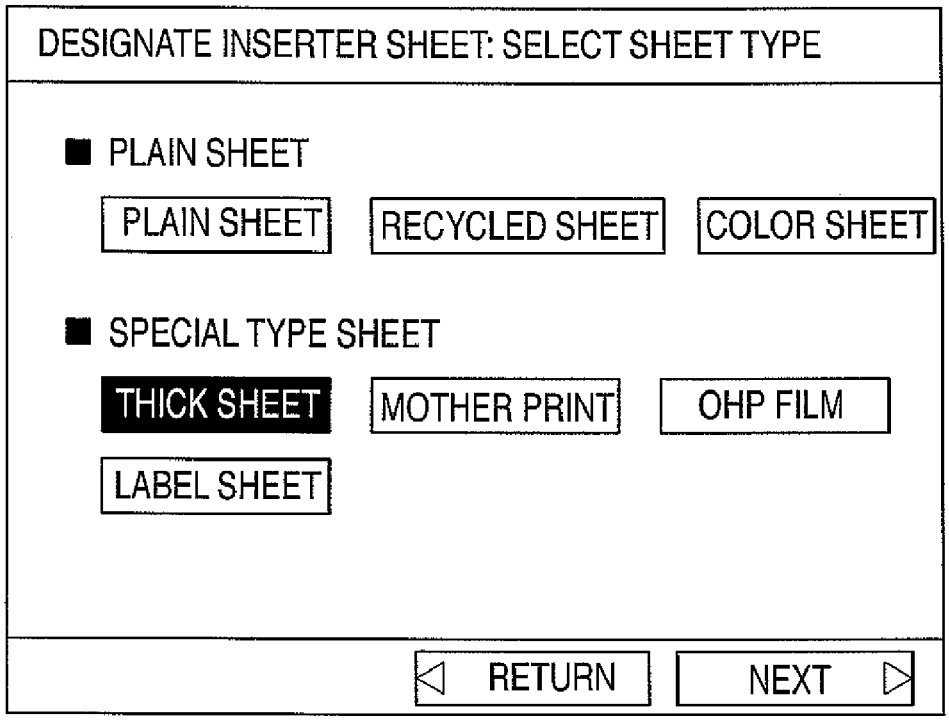
FIG. 27 is a view useful in explaining a "sheet type selection screen" displayed on the display panel in a step S2407 in FIG. 25.

As shown in FIG. 25, the CPU circuit section 560 determines whether or not sheets are stacked using a sheet set sensor, not shown, on the insert tray 901 (step S2401) If the sheets are stacked, the CPU circuit section 560 causes a "sheet size selection" screen (FIG. 26) to be displayed on the display panel of the operating section 1 (step S2403) and determines whether or not the size has been determined (step S2405). The CPU circuit section 560 repeatedly carries out the above determination until the size is determined, and when the size is determined, the CPU circuit section 560 causes a "sheet type selection" screen (FIG. 27) to be displayed on the display panel (step S2407) and determines whether or not the sheet type has been determined. The CPU circuit section repeatedly carries out the above determination until the sheet type is determined, and when the sheet type is determined, the CPU circuit section 560 determines whether or not the sheet type is a special type (step S2411). If the sheet type is a special type, the CPU circuit section 560 turns on a special sheet flag "special_material_flg" (step S2415). If the sheet type is a special type, the CPU circuit section 560 turns off the special sheet flag "special_material_flg" (step S2413) and goes to a step S2417.

Next, in the step S2417, the CPU circuit section 560 causes a "sheet orientation selection" screen (FIG. 28) to be displayed on the display panel and determines whether or not the special sheet flag "special_material_flg" is on (step S2419). If the special sheet flag "special_material_flg" is off, the CPU circuit section 560 turns off an inverted sheet feed alarm flag "rev_set_alarm_flg" (step S2422) (FIG. 28) and goes to a step S2425, described later. If the special sheet flag "special_material_flg" is on, the CPU circuit section 560 checks the status of the "sheet orientation selection" screen (FIG. 29) to determine whether or not a back cover is designated (step S2421). If a back cover is designated, the CPU circuit section 560 carries out the processing in the step S2422, and if a back cover is not designated, the CPU circuit section 560 causes an alarm and a user guide to be displayed on the display panel (step S2423) (FIG. 28), and goes to the step S2425, described later. In the user guide, a possibility that a sheet of the determined sheet type is not properly inserted into a sheet bundle discharged from the printer section 300 is written so as to prompt the user to confirm and change the orientations (front and back sides) of sheets stacked on the insert tray 901. This can prevent troubles such as sheet buckling and jamming.

Next, in the step S2425, the CPU circuit section 560 determines whether or not the sheet orientation has been determined. If the sheet orientation has been determined, the CPU circuit section 560 determines whether or not the inverted sheet feed alarm flag "rev_set_alarm_flg" is on (step S2427). If the inverted sheet feed alarm flag "rev_set_alarm_flg" is off, the CPU circuit section 560 immediately terminates the present process, and if the inverted sheet feed alarm flag "rev_set_alarm_flg" is on, the CPU circuit section 560 inhibits inverted sheet discharge (step S2429) and terminates the present process.

According to the process in FIG. 25, if a special sheet type has been designated and a back cover has not been designated, the CPU circuit section 560 displays the alarm and the user guide on the display panel and inhibits inverted sheet discharge. Thus, sheets of a special type such as thick sheets can be inhibited from passing through the inversion path 955 which is intended to invert sheets, and there is no need to increase the curve of the inversion path 955. It is therefore possible to downsize the apparatus and prevent buckling, jamming, etc. of special type sheets. In many cases, a sheet supplied from the inserter 900 is a value-added sheet or a sheet on which an image cannot be easily formed by the copying apparatus 1000; e.g. a sheet with an image such as a photograph formed thereon, the front cover of a catalogue, a calendared sheet, and a colored sheet. In such cases, the above described effects can be enhanced.

It is to be understood that the object of the present invention may also be accomplished by supplying a system or an apparatus with a storage medium in which a program code of software, which realizes the functions of the above described embodiment is stored, and causing a computer (or CPU or MPU) of the system or apparatus to read out and execute the program code stored in the storage medium.

In this case, the program code itself read from the storage medium realizes the functions of the above described embodiment, and hence the program code and the storage medium in which the program code is stored constitute the present invention.

Examples of the storage medium for supplying the program code include a floppy (registered trademark) disk, a hard disk, a magnetic-optical disk, a CD-ROM, a CD-R, a CD-RW, a DVD-ROM, a DVD-RAM, a DVD-RW, and a DVD+RW, a magnetic tape, a nonvolatile memory card, and a ROM. Alternatively, the program code may be downloaded via a network.

Further, it is to be understood that the functions of the above described embodiment may be accomplished not only by executing a program code read out by a computer, but also by causing an OS (operating system) or the like which operates on the computer to perform a part or all of the actual operations based on instructions of the program code.

Further, it is to be understood that the functions of the above described embodiment may be accomplished by writing a program code read out from the storage medium into a memory provided on an expansion board inserted into a computer or in an expansion unit connected to the computer and then causing a CPU or the like provided in the expansion board or the expansion unit to perform a part or all of the actual operations based on instructions of the program code.

This application claims priority from Japanese Patent Application No. 2005-285059 filed Sep. 29, 2005, which is hereby incorporated by reference herein in its entirety.

What is claimed is:

1. A sheet processing apparatus connected to an image forming apparatus that forms images corresponding to a set operation mode on sheets, comprising:

a first stacking section that stacks sheets;

a curved inversion path that inverts the sheets;

a sheet feed section that feeds the sheets stacked in said first stacking section in one of a first sheet feed mode in which sheets are fed after being inverted by said inversion path and a second sheet feed mode in which sheets are fed without passing through said inversion path;

a conveying section that conveys the sheets fed by said sheet feed section and the sheets with the images formed thereon;

a second stacking section that stacks the conveyed sheets;

a sheet processing section that performs predetermined processing on the sheets stacked in said second stacking section;

a setting section that sets sheet information about the sheets stacked in said first stacking section;

a determining section that determines whether a predetermined information is included in the set sheet information;

a display section that displays a predetermined message when the predetermined information is included in the set sheet information; and an inhibiting section that inhibits the inversion of the sheets by said inversion path when the predetermined information is included in the set sheet information.

2. A sheet processing apparatus according to claim 1, wherein the predetermined information comprises information indicative of a special type sheet.

3. A sheet processing apparatus connected to an image forming apparatus that forms images corresponding to a set operation mode on sheets, comprising:

a first stacking section that stacks sheets;

a curved inversion path that inverts the sheets;

a sheet feed section that feeds the sheets stacked in said first stacking section in one of a first sheet feed mode in which sheets are fed after being inverted by said inversion path and a second sheet feed mode in which sheets are fed without passing through said inversion path;

a conveying section that conveys the sheets fed by said sheet feed section and the sheets with the images formed thereon;

a second stacking section that stacks the conveyed sheets;

a sheet processing section that performs predetermined processing on the sheets stacked in said second stacking section;

a setting section that sets sheet information about the sheets stacked in said first stacking section;

a determining section that determines whether a predetermined information is included in the set sheet information; and a display section that displays a predetermined message when the predetermined information is included in the set sheet information, wherein the predetermined message comprises a message notifying a user that the inversion of the sheets by said inversion path has been inhibited.

4. A sheet processing apparatus according to claim 3, wherein the predetermined information comprises information indicative of a special type sheet.

5. A sheet processing apparatus connected to an image forming apparatus that forms images corresponding to a set operation mode on sheets, comprising:

a first stacking section that stacks sheets;

a curved inversion path that inverts the sheets;

a sheet feed section that feeds the sheets stacked in said first stacking section in one of a first sheet feed mode in which sheets are fed after being inverted by said inversion path and a second sheet feed mode in which sheets are fed without passing through said inversion path;

a conveying section that conveys the sheets fed by said sheet feed section and the sheets with the images formed thereon;

a second stacking section that stacks the conveyed sheets;

a sheet processing section that performs predetermined processing on the sheets stacked in said second stacking section;

a setting section that sets sheet information about the sheets stacked in said first stacking section;

a determining section that determines whether a predetermined information is included in the set sheet information; and a display section that displays a predetermined message when the predetermined information is included in the set sheet information, wherein the predetermined message comprises a message prompting a user to confirm an orientation of the sheets stacked in said first stacking section.

6. A sheet processing apparatus according to claim 5, wherein the predetermined information comprises information indicative of a special type sheet.

7. A sheet processing apparatus connected to an image forming apparatus that forms images corresponding to a set operation mode on sheets, comprising:

a first stacking section that stacks sheets;

a curved inversion path that inverts the sheets;

a sheet feed section that feeds the sheets stacked in said first stacking section in one of a first sheet feed mode in which sheets are fed after being inverted by said inversion path and a second sheet feed mode in which sheets are fed without passing through said inversion path;

a conveying section that conveys the sheets fed by said sheet feed section and the sheets with the images formed thereon;

a second stacking section that stacks the conveyed sheets;

a sheet processing section that performs predetermined processing on the sheets stacked in said second stacking section;

a setting section that sets sheet information about the sheets stacked in said first stacking section;

a determining section that determines whether a predetermined information is included in the set sheet information; and a display section that displays a predetermined message when the predetermined information is included in the set sheet information, wherein the predetermined message comprises a message prompting a user to change an orientation of the sheets stacked in said first stacking section.

8. A sheet processing apparatus according to claim 7, wherein the predetermined information comprises information indicative of a special type sheet.

9. A sheet processing method for controlling a sheet processing apparatus connected to an image forming apparatus that forms images corresponding to a set operation mode on sheets, the sheet processing apparatus comprising a first stacking section that stacks sheets, a curved inversion path that inverts the sheets, a sheet feed section that feeds the sheets stacked in the first stacking section in one of a first sheet feed mode in which sheets are fed after being inverted by the inversion path and a second sheet feed mode in which sheets are fed without passing through the inversion path, a conveying section that conveys the sheets fed by the sheet feed section and the sheets with the images formed thereon, a second stacking section that stacks the conveyed sheets, and a sheet processing section that performs predetermined processing on the sheets stacked in the second stacking section, the method comprising:

a setting step of setting sheet information about the sheets stacked in the first stacking section;

a determining step of determining whether a predetermined information is included in the set sheet information;

a display step of displaying a predetermined message when the predetermined information is included in the set sheet information; and an inhibiting step of inhibiting the inversion of the sheets by the inversion path when the predetermined information is included in the set sheet information.

10. A sheet processing method according to claim 9, wherein the predetermined information comprises information indicative of a special type sheet.

11. A sheet processing method for controlling a sheet processing apparatus connected to an image forming apparatus that forms images corresponding to a set operation mode on sheets, the sheet processing apparatus comprising a first stacking section that stacks sheets, a curved inversion path that inverts the sheets, a sheet feed section that feeds the sheets stacked in the first stacking section in one of a first sheet feed mode in which sheets are fed after being inverted by the inversion path and a second sheet feed mode in which sheets are fed without passing through the inversion path, a conveying section that conveys the sheets fed by the sheet feed section and the sheets with the images formed thereon, a second stacking section that stacks the conveyed sheets, and a sheet processing section that performs predetermined processing on the sheets stacked in the second stacking section, the method comprising:

a setting step of setting sheet information about the sheets stacked in the first stacking section;

a determining step of determining whether a predetermined information is included in the set sheet information; and a display step of displaying a predetermined message when the predetermined information is included in the set sheet information, wherein the predetermined message comprises a message notifying a user that the inversion of the sheets by the inversion path has been inhibited.

12. A sheet processing method according to claim 11, wherein the predetermined information comprises information indicative of a special type sheet.

13. A sheet processing method for controlling a sheet processing apparatus connected to an image forming apparatus that forms images corresponding to a set operation mode on sheets, the sheet processing apparatus comprising a first stacking section that stacks sheets, a curved inversion path that inverts the sheets, a sheet feed section that feeds the sheets stacked in the first stacking section in one of a first sheet feed mode in which sheets are fed after being inverted by the inversion path and a second sheet feed mode in which sheets are fed without passing through the inversion path, a conveying section that conveys the sheets fed by the sheet feed section and the sheets with the images formed thereon, a second stacking section that stacks the conveyed sheets, and a sheet processing section that performs predetermined processing on the sheets stacked in the second stacking section, the method comprising:

a setting step of setting sheet information about the sheets stacked in the first stacking section;

a determining step of determining whether a predetermined information is included in the set sheet information; and a display step of displaying a predetermined message when the predetermined information is included in the set sheet information, wherein the predetermined message comprises a message prompting a user to confirm an orientation of the sheets stacked in the first stacking section.

14. A sheet processing method according to claim 13, wherein the predetermined information comprises information indicative of a special type sheet.

15. A sheet processing method for controlling a sheet processing apparatus connected to an image forming apparatus that forms images corresponding to a set operation mode on sheets, the sheet processing apparatus comprising a first stacking section that stacks sheets, a curved inversion path that inverts the sheets, a sheet feed section that feeds the sheets stacked in the first stacking section in one of a first sheet feed mode in which sheets are fed after being inverted by the inversion path and a second sheet feed mode in which sheets are fed without passing through the inversion path, a conveying section that conveys the sheets fed by the sheet feed section and the sheets with the images formed thereon, a second stacking section that stacks the conveyed sheets, and a sheet processing section that performs predetermined processing on the sheets stacked in the second stacking section, the method comprising:

a setting step of setting sheet information about the sheets stacked in the first stacking section;

a determining step of determining whether a predetermined information is included in the set sheet information; and a display step of displaying a predetermined message when the predetermined information is included in the set sheet information, wherein the predetermined message comprises a message prompting a user to change an orientation of the sheets stacked in the first stacking section.

16. A sheet processing method according to claim 15, wherein the predetermined information comprises information indicative of a special type sheet.

17. An image forming apparatus comprising;

an image forming section that forms images on sheets;

a first stacking section that stacks sheets;

a curved inversion path that inverts the sheets;

a sheet feed section that feeds the sheets stacked in said first stacking section in one of a first sheet feed mode in which sheets are fed after being inverted by said inversion path and a second sheet feed mode in which sheets are fed without passing through said inversion path;

a conveying section that conveys the sheets fed by said sheet feed section and the sheets with the images formed thereon;

a second stacking section that stacks the conveyed sheets;

a sheet processing section that performs predetermined processing on the sheets stacked in said second stacking section;

a setting section that sets sheet information about the sheets stacked in said first stacking section;

a determining section that determines whether a predetermined information is included in the set sheet information;

a display section that displays a predetermined message when the predetermined information is included in the set sheet information; and an inhibiting section that inhibits the inversion of the sheets by said inversion path when the predetermined information is included in the set sheet information.

18. An image forming apparatus comprising:

an image forming section that forms images on sheets;

a first stacking section that stacks sheets;

a curved inversion path that inverts the sheets;

a sheet feed section that feeds the sheets stacked in said first stacking section in one of a first sheet feed mode in which sheets are fed after being inverted by said inversion path and a second sheet feed mode in which sheets are fed without passing through said inversion path;

a conveying section that conveys the sheets fed by said sheet feed section and the sheets with the images formed thereon;

a second stacking section that stacks the conveyed sheets;

a sheet processing section that performs predetermined processing on the sheets stacked in said second stacking section;

a setting section that sets sheet information about the sheets stacked in said first stacking section;

a determining section that determines whether a predetermined information is included in the set sheet information; and a display section that displays a predetermined message when the predetermined information is included in the set sheet information, wherein the predetermined message comprises a message notifying a user that the inversion of the sheets by said inversion path has been inhibited.

19. An image forming apparatus comprising:

an image forming section that forms images on sheets;

a first stacking section that stacks sheets;

a curved inversion path that inverts the sheets;

a sheet feed section that feeds the sheets stacked in said first stacking section in one of a first sheet feed mode in which sheets are fed after being inverted by said inversion path and a second sheet feed mode in which sheets are fed without passing through said inversion path;

a conveying section that conveys the sheets fed by said sheet feed section and the sheets with the images formed thereon;

a second stacking section that stacks the conveyed sheets;

a sheet processing section that performs predetermined processing on the sheets stacked in said second stacking section;

a setting section that sets sheet information about the sheets stacked in said first stacking section;

a determining section that determines whether a predetermined information is included in the set sheet information; and a display section that displays a predetermined message when the predetermined information is included in the set sheet information, wherein the predetermined message comprises a message prompting a user to confirm an orientation of the sheets stacked in said first stacking section.

20. An image forming apparatus comprising:

an image forming section that forms images on sheets;

a first stacking section that stacks sheets;

a curved inversion path that inverts the sheets;

a sheet feed section that feeds the sheets stacked in said first stacking section in one of a first sheet feed mode in which sheets are fed after being inverted by said inversion path and a second sheet feed mode in which sheets are fed without passing through said inversion path;

a conveying section that conveys the sheets fed by said sheet feed section and the sheets with the images formed thereon;

a second stacking section that stacks the conveyed sheets;

a sheet processing section that performs predetermined processing on the sheets stacked in said second stacking section;

a setting section that sets sheet information about the sheets stacked in said first stacking section;

a determining section that determines whether a predetermined information is included in the set sheet information; and a display section that displays a predetermined message when the predetermined information is included in the set sheet information, wherein the predetermined message comprises a message prompting a user to change an orientation of the sheets stacked in said first stacking section.

* * * * *